US012448203B2

(12) United States Patent
Vlasveld et al.

(10) Patent No.: US 12,448,203 B2
(45) **Date of Patent: *Oct. 21, 2025**

(54) PRESSURE REGULATING SYSTEM FOR A BEVERAGE CONTAINER AND BEVERAGE CONTAINER PROVIDED THEREWITH

(71) Applicant: Heineken Supply Chain B.V., Amsterdam (NL)

(72) Inventors: Daniël Petrus Nicolaas Vlasveld, Amsterdam (NL); Allard De Groot, Amsterdam (NL); Rudolf Klaas Van Beelen, Amsterdam (NL); Wolter Wolthers, Amsterdam (NL)

(73) Assignee: Heineken Supply Chain B.V., Amsterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 18/772,434

(22) Filed: Jul. 15, 2024

(65) Prior Publication Data

US 2024/0367889 A1 Nov. 7, 2024

Related U.S. Application Data

(63) Continuation of application No. 17/629,470, filed as application No. PCT/NL2020/050483 on Jul. 23, 2020, now Pat. No. 12,065,303.

(30) Foreign Application Priority Data

Jul. 24, 2019 (NL) ..... 2023563

(51) Int. Cl.

| | |
|---|---|
| ***B65D 83/70*** | (2006.01) |
| ***B65D 83/384*** | (2025.01) |
| ***B65D 83/60*** | (2006.01) |

(52) U.S. Cl.
CPC ..... *B65D 83/70* (2013.01); *B65D 83/384* (2013.01); *B65D 83/673* (2025.01)

(58) Field of Classification Search
CPC .... B65D 83/70; B65D 83/384; B65D 83/663; B65D 77/22; B65D 85/72; B67D 1/0802;
(Continued)

(56) References Cited

U.S. PATENT DOCUMENTS 3,460,555 A 8/1969 Puster
5,144,831 A 9/1992 Hale et al.
(Continued)

FOREIGN PATENT DOCUMENTS

EP 0371200 A1 6/1990
EP 1064221 A1 1/2001
(Continued)

OTHER PUBLICATIONS

International Search Report for corresponding International Application No. PCT/NL2020/050483 dated Sep. 28, 2020, 4 pages.

*Primary Examiner* — Bob Zadeh
(74) *Attorney, Agent, or Firm* — Banner & Witcoff, Ltd.

(57) ABSTRACT

A pressure regulating system for a beverage container system, comprising a first compartment for containing a pressurized, in fluid communication with a surrounding space through at least a gas valve for opening and closing a passage between the first compartment and surrounding space, wherein a gas valve control system is provided, comprising a deformable and/or movable wall or wall part, wherein said deformable and/or movable wall part is operably in contact with said gas valve for opening and/or closing said gas valve, wherein a second compartment is provided at a side of the said deformable and/or movable wall part, said movable and/or deformable wall part forming a wall of said second compartment, wherein the second
(Continued)

compartment forms a pressure regulating space and comprises a wall part formed by or comprising at least a gas permeable, liquid tight permeable wall part.

12 Claims, 17 Drawing Sheets

(58) Field of Classification Search
CPC ..... B67D 2001/0824; B67D 1/1252; B67D 1/0418
See application file for complete search history.

(56) References Cited

U.S. PATENT DOCUMENTS 5,285,931 A * 2/1994 Alfons ..... B65D 83/673 222/61
5,439,137 A * 8/1995 Grollier ..... B65D 83/673 222/394
6,412,668 B1 7/2002 Vlooswijk et al.
2005/0109098 A1 5/2005 DiFoggio
2009/0289085 A1 11/2009 Schiff et al.
2010/0059543 A1* 3/2010 Paauwe ..... B67D 1/0418 222/399
2012/0058230 A1 3/2012 Rasmussen et al.
2013/0074978 A1 3/2013 Rasmussen et al.
2014/0027453 A1* 1/2014 Landman ..... B67D 1/008 220/203.01
2017/0113915 A1* 4/2017 Wolthers ..... B65D 83/673
2018/0140754 A1 5/2018 Spiegelberg
2019/0009223 A1 1/2019 Mikawa et al.
2024/0367889 A1* 11/2024 Vlasveld ..... B65D 83/70

FOREIGN PATENT DOCUMENTS

WO 200035774 A1 6/2000
WO 2009062626 A2 5/2009
WO 2011157786 A1 12/2011
WO 2015190926 A1 12/2015

* cited by examiner

PRESSURE REGULATING SYSTEM FOR A BEVERAGE CONTAINER AND BEVERAGE CONTAINER PROVIDED THEREWITH

The disclosure relates to a beverage dispensing system with a pressurizing system which is self regulating. The disclosure relates to a method for manufacturing of a pressure regulator and a method for preparing a pressure regulator for use. The disclosure furthermore relates to a beverage container comprising a pressure regulator of the disclosure, wherein the container is or can be filled with a gaseous beverage, such as a carbonated beverage.

In EP1064221 a beverage dispensing system is disclosed, comprising a container with a self regulating pressurizing system. The pressurizing system comprises a gas container comprising pressurized gas, a closure closing the gas container and a pressure regulator operative for opening the closure for allowing gas to enter into the beverage compartment from the gas container. The pressure regulator comprises a regulating chamber having at least a wall part movable based on a pressure difference between the beverage compartment and regulating chamber, such that when the pressure drops in the beverage compartment, for example due to dispensing beverage therefrom, the movable wall will move and will open the closure of the gas container, allowing gas to enter into the beverage compartment, increasing the pressure therein. This will move the movable wall back, allowing the closure to close again once the desired pressure in the beverage compartment is reached. Similar regulators are disclosed in for example EP1064221 and WO200035774.

These regulators have the problem that $CO_2$ gas may enter into the regulating chamber due to migration of the gas through the wall into the chamber for equalizing the partial pressure of $CO_2$ gas on either side of said wall, which gas will not leave the chamber anymore during use of the regulator. This will increase the internal pressure in said chamber over time, which will increase the regulating pressure inside the beverage compartment accordingly. Furthermore these pressurizing systems have the disadvantage that the regulating pressure is set at a given, predetermined value, such that at a predetermined, preferred temperature of the beverage the pressure will be regulated at about the equilibrium pressure of the beverage, such that the carbonation of the beverage at that temperature will not change. This means that at other temperatures the pressure will be regulated above or below said equilibrium pressure and thus will lead to over or under saturation of gas in the beverage. Moreover, when the beverage is cooled to a low temperature, this may reduce the pressure inside the container to such a level that the pressure regulator will start regulating undesirably.

In WO2015/190926 a beverage dispensing system is disclosed in which a pressure regulator is used which should overcome at least some of these problems of previously known pressure regulators. In this known system the pressure regulator comprises a first compartment for containing a pressurized gas. This first compartment is in fluid communication with an outlet space through at least a gas valve for opening and closing a passage between the first compartment and the outlet space. A gas valve control system is provided, comprising a deformable or movable wall part of said outlet space. The deformable or movable wall part is operably in contact with said gas valve for opening and closing the gas valve. A second compartment is provided at a side of the said deformable or movable wall part opposite the outlet space. In this known system the second compartment is in fluid communication with the beverage compartment of the beverage container through a small opening or a set of openings, such that gas from the second compartment can flow into the beverage compartment and vice versa. The opening or openings together are so small that such flow from the second compartment into the beverage compartment and vice versa can only happen relatively slowly. Hence in theory the pressure inside the second compartment can adjust relatively slowly to the pressure inside the beverage compartment.

It has been found that in practice a pressure regulator as disclosed in WO2015/190926 does not always perform properly. Undesired pressure fluctuations during use still occur. Therefore there is a desire to further improve a pressure regulator for a beverage container.

An aim of the present disclosure is to provide for a pressure regulator which is an alternative to the known pressure regulators.

One of the objects of the disclosure is to provide for a pressure regulator which can automatically regulate pressure in a beverage container, especially a beverage container comprising a gaseous and/or pressurized beverage, such as beer. An object is to provide a pressure regulator which can adjust a regulating pressure to for example changes in beverage temperature and/or gas content.

An object of the present disclosure is to provide for a beverage container, preferably self pressurizing. An object of the present disclosure is to provide for a method for preparing a pressure regulator for use in a beverage container comprising a pressurized, gas containing beverage, such as beer. An object of the present disclosure is to provide for a method for manufacturing a pressure regulator or at least part thereof.

At least one of these aims and objectives and/or other objects are obtained at least in part by a pressure regulator as disclosed.

In an aspect the disclosure is directed to a pressure regulating system for a beverage container system can comprise a first compartment for containing a pressurized gas. Said first compartment can be in fluid communication with an adjoining space through at least a gas valve for opening and closing a passage between the first compartment and the adjoining space. A gas valve control system is provided, which can comprise a deformable and/or movable wall or wall part, wherein said deformable and/or movable wall part is operably in contact with said gas valve for opening and/or closing said gas valve. A second compartment is provided at a side of the said deformable and/or movable wall part, said movable and/or deformable wall part forming a wall of said second compartment, wherein the second compartment forms a pressure regulating space. The second compartment comprises a wall part formed by or comprising at least a gas permeable, liquid tight permeable wall part, during use e.g. allowing gas to enter into the second compartment (and/or leave therefrom) but keeping liquid from entering said second compartment.

In an aspect the disclosure is directed to a pressure regulator which comprises a first compartment for containing a pressurized gas. The first compartment is or can be brought in fluid communication with outlet adjoining space through at least a gas valve for opening and closing a passage between the first compartment and the adjoining space. A gas valve control system is provided, comprising a deformable and/or movable wall or wall part of a second space, wherein said deformable and/or movable wall part is operably in contact with said gas valve for opening and/or closing said gas valve. The second compartment is provided at a side of the said deformable and/or movable wall part opposite the adjoining space. A pressure regulator according to the disclosure can further be characterized in that the second compartment has a wall part made of or comprising a gas permeable, fluid tight permeable wall part.

Surprisingly it has been found that by forming part of the wall of the second compartment by or using a gas permeable, fluid tight permeable wall part, the pressure regulation by the pressure regulator can be significantly improved.

In embodiments the permeable wall part can have a hydrophobic coating or impregnation and/or can be made using a hydrophobic material.

In embodiments the permeable wall part can be provided with or supported by a support frame, which support frame can advantageously have a higher stiffness than the permeable wall part. Preferably the permeable wall part with the support frame has a stiffness similar to the stiffness of the further wall of the second compartment not formed by the movable and/or deformable wall part. This can have the advantage that the permeable wall part will not deform due to pressure differences over the permeable wall part, at least not significantly different from the said further wall part not formed by the movable and/or deformable wall part.

The permeable wall part is preferably formed such that gas, especially gas as is contained in the first compartment and/or in a beverage with which the system is to be used, such as $CO_2$ gas, $N_2$ gas or a mixture thereof, can pass through the permeable wall part at a pressure difference over said permeable wall part and/or at a difference in concentration of said gas over said permeable wall part, whereas liquid, especially water or beer, is prevented from passing through said permeable wall part into the second compartment. The permeable wall part can for example be made of silicon. A permeable wall part of a pressure regulator or regulating system can for example have a gas permeability of e.g. 1000 to 4000 barrer.

During use the volume of gas passing through the permeable wall part per unit of time is preferably such that a relatively quick pressure drop in the adjoining space, for example due to dispensing of a volume of beverage from the adjoining space, will lead to a increase of volume of the second compartment and a reduction of pressure in said second compartment because it cannot be compensated for by the transmission of gas through the permeable wall part in the same time frame as the time frame of pressure dropping in the adjoining space.

In general terms, the permeability through the permeable wall part can be such that a relatively rapid reduction or expansion of the volume of the second compartment, by deformation and/or movement of the movable and/or deformable wall of the second compartment provides for a pressure increase respectively decrease in the second compartment, which is subsequently relieved through passing of gas into the second compartment from the adjoining space, such as from a beverage compartment in which the pressure regulator is used, or vice versa.

During use at least the first and second compartment can be substantially filled with the same gas or gas mixture, in gaseous and/or liquid form, especially $CO_2$. Obviously other gases can be used, for example $N_2$, or gas mixtures. In embodiments the gas or gas mixture can be the same as a gas or gas mixture in a beverage to be dispensed.

In embodiments the second compartment can comprise at least one flushing opening, which during use of the regulator for pressure regulation is closed. Such flushing opening allows flushing of the second compartment with a gas or gas mixture, especially a gas or gas mixture used for pressurizing the beverage, which opening of openings are closed after such flushing.

The disclosure is further directed to a beverage container, comprising a pressure regulator of the disclosure. The passage comprising the gas valve can open, directly or indirectly, into a beverage compartment of the beverage container. The permeable wall part can be directly or indirectly, in fluid contact with said beverage compartment.

The disclosure is further directed to a method for preparing a pressure regulator according to the disclosure, wherein at least the second compartment is purged with a gas or gas mixture present in a beverage to be pressurized with said pressure regulator. Such gas can for example be $CO_2$ gas or a $CO_2/N_2$ gas mixture. In embodiments the second compartment is flushed with said gas or gas mixture, by feeding the gas or gas mixture into the second compartment through a first opening and allowing air to be forced out of said second compartment by said gas or gas mixture through a second opening, and subsequently closing the openings. Such purging can be done directly prior to or directly after placing the pressure regulator in the beverage container and closing the container when filled with the beverage. Such beverage can be a carbonated beverage such as beer.

In embodiments the permeable wall part can connect the pressure regulating chamber (i.e. second compartment) directly with the beverage compartment. In embodiments the permeable wall part can connect the pressure regulating chamber with a third compartment extending over said permeable wall part, preventing direct communication between the pressure regulating chamber and the beverage compartment. Such third compartment is formed such that its volume can change easily without significant change in pressure in said third compartment. In a further embodiment of a method for preparing a pressure regulator, the third compartment is also purged with said gas or gas mixture.

In clarification of the invention, exemplary embodiments of pressure regulators, beverage containers and methods according to the disclosure will be further elucidated with reference to the drawings. In the drawings:

FIGS. 1 and 2, with a third compartment;

Figure 4B:
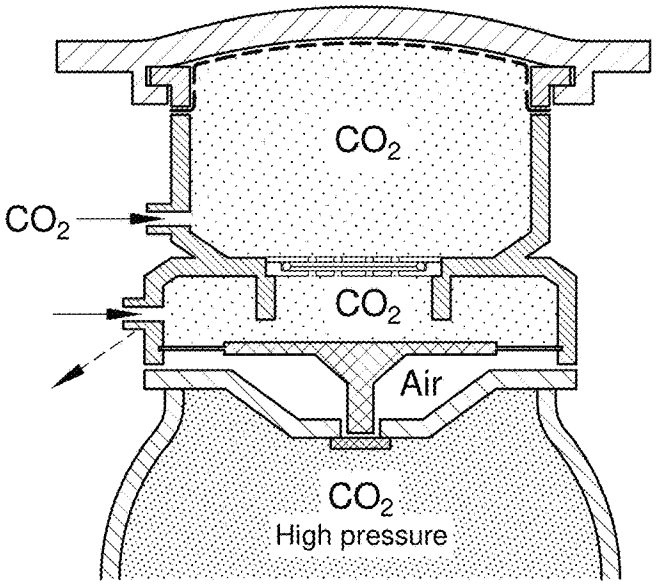
Figure 4C:
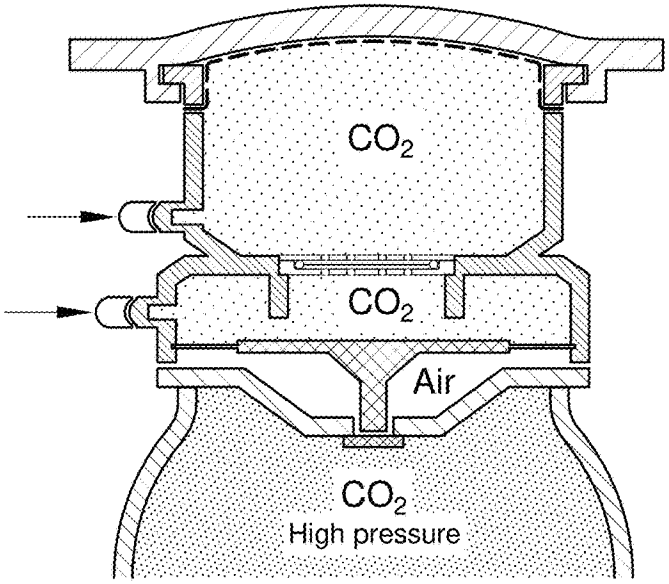
Figure 4A:
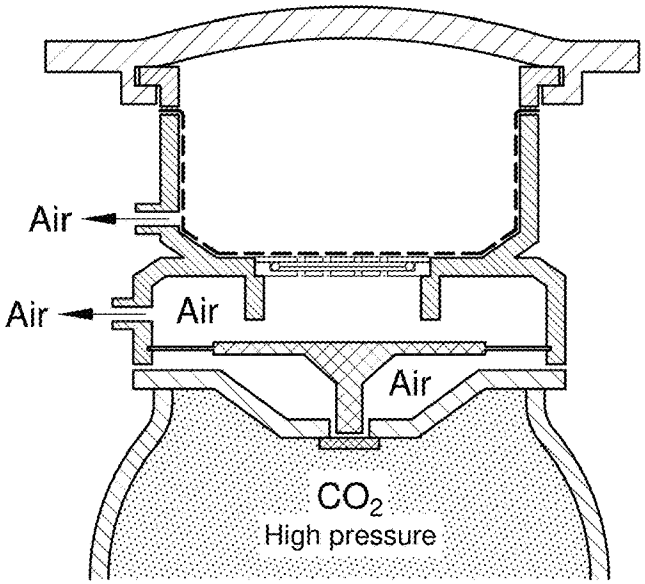
Figure 5A:
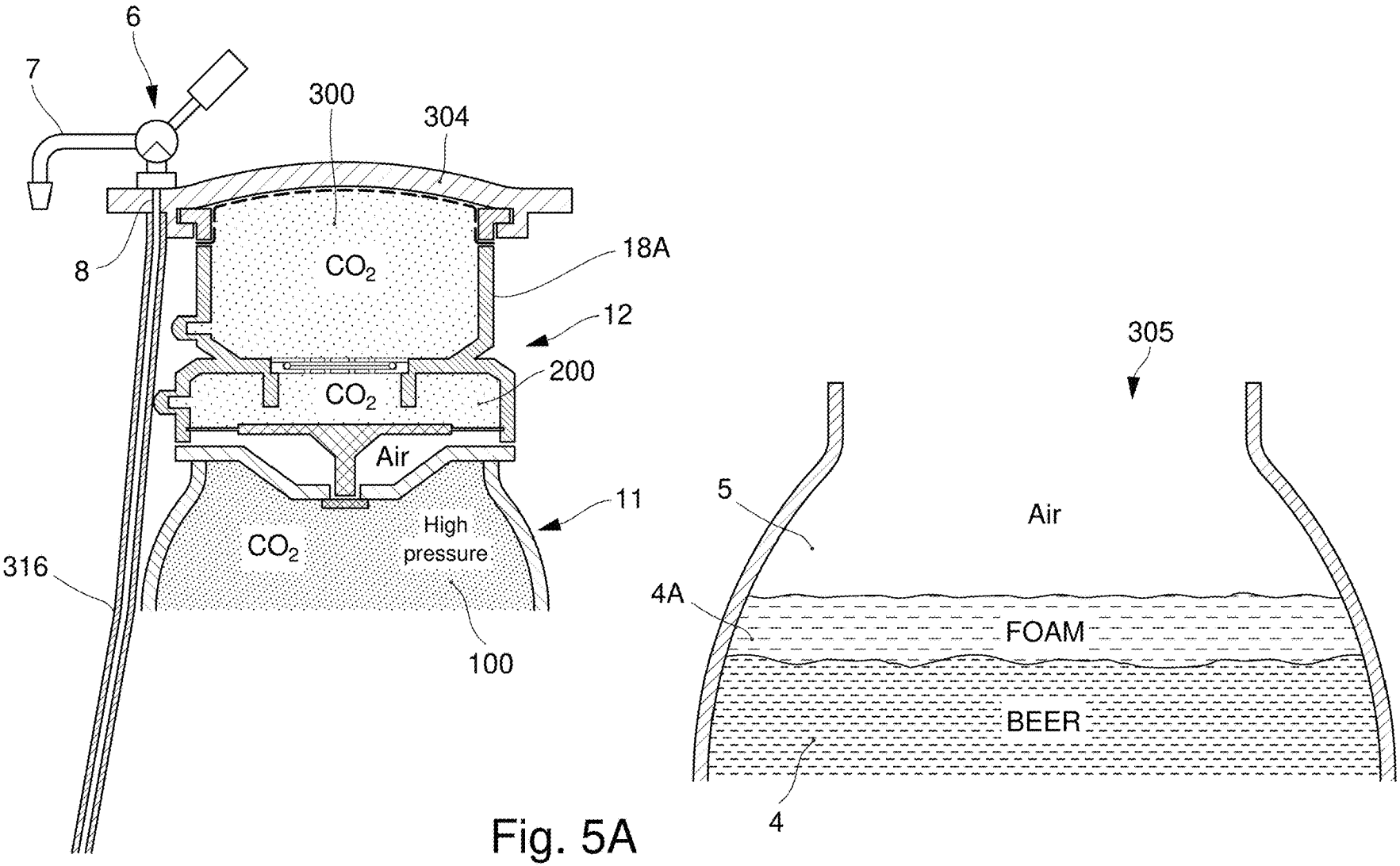
Figure 6:
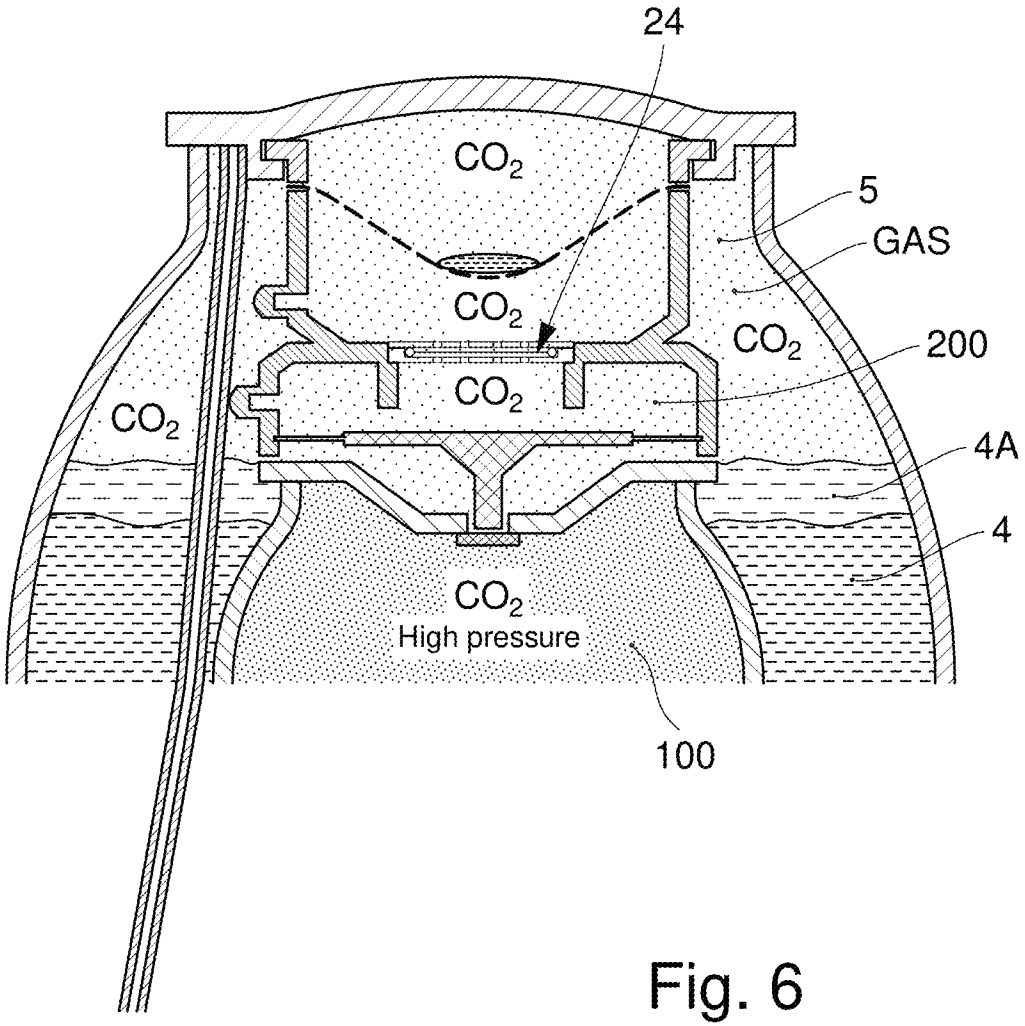
Figure 7B:
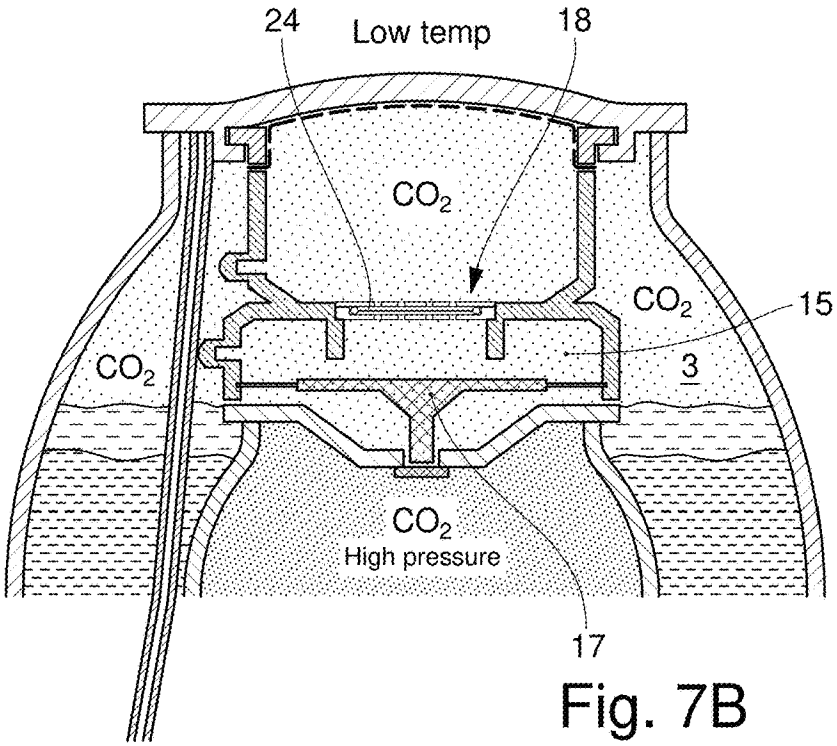
Figure 7A:
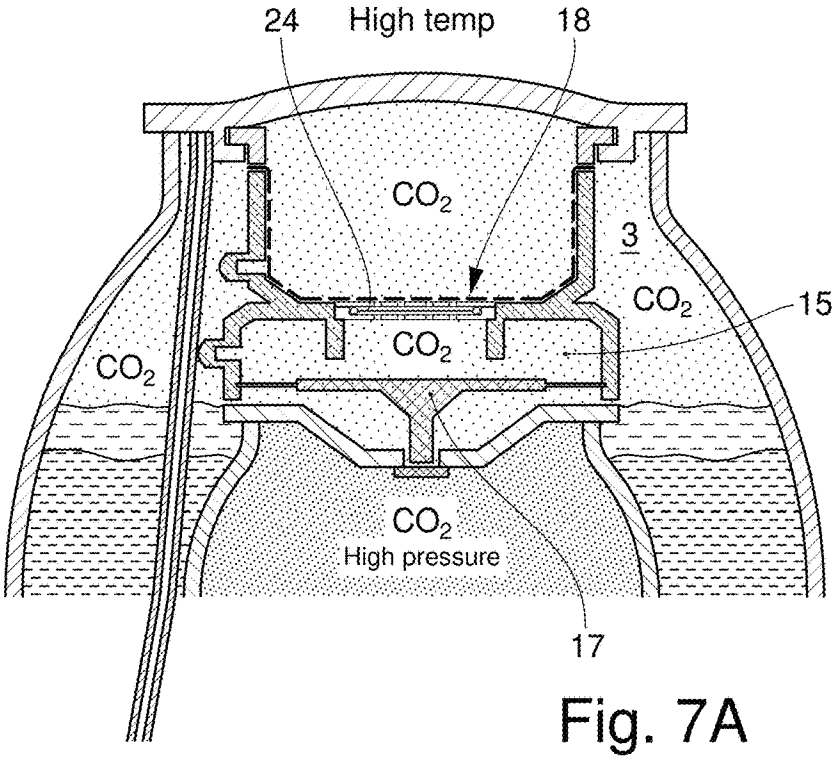
Figure 8B:
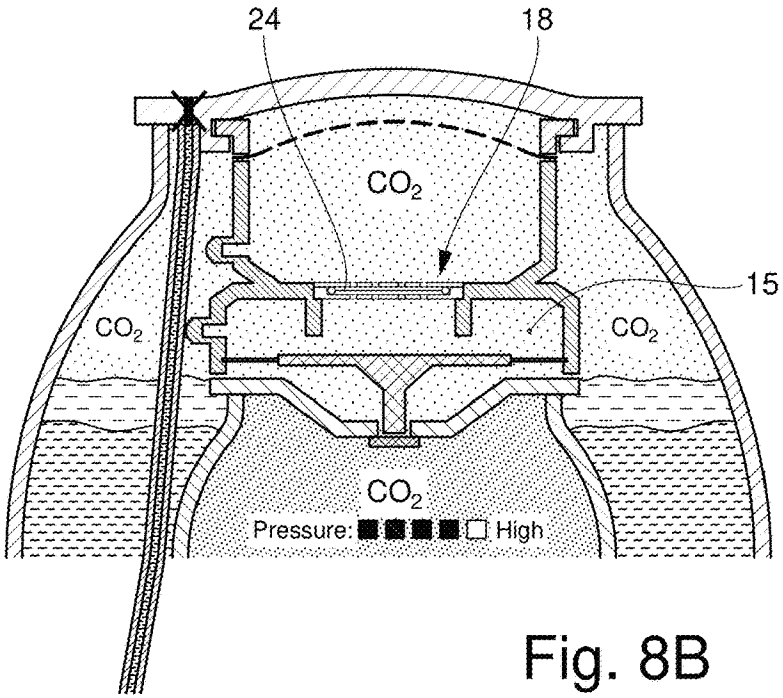
Figure 8A:
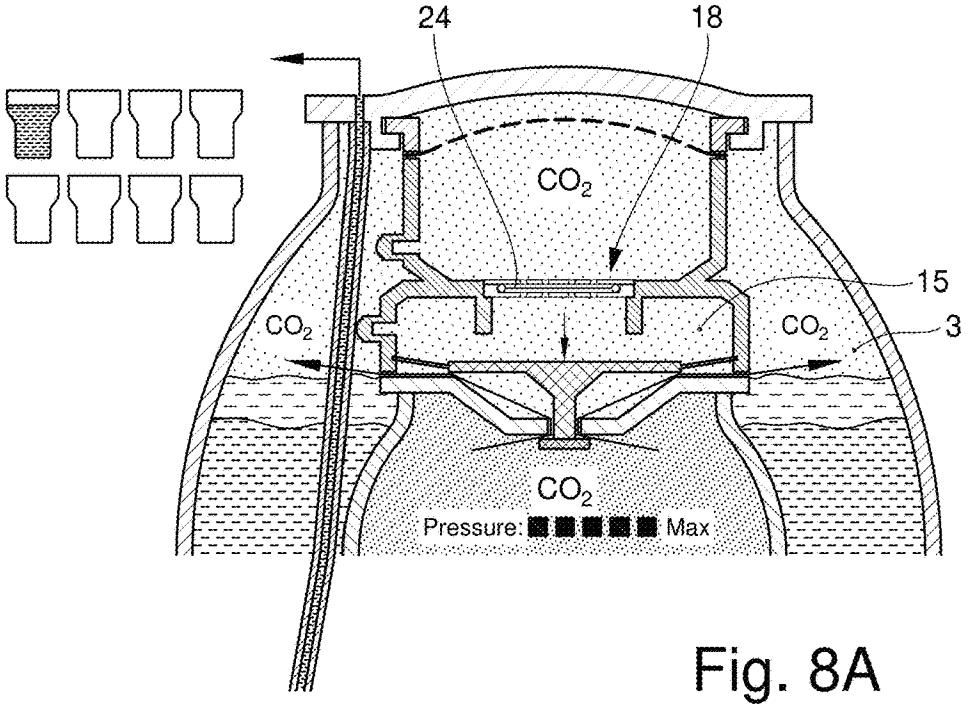
Figure 9:
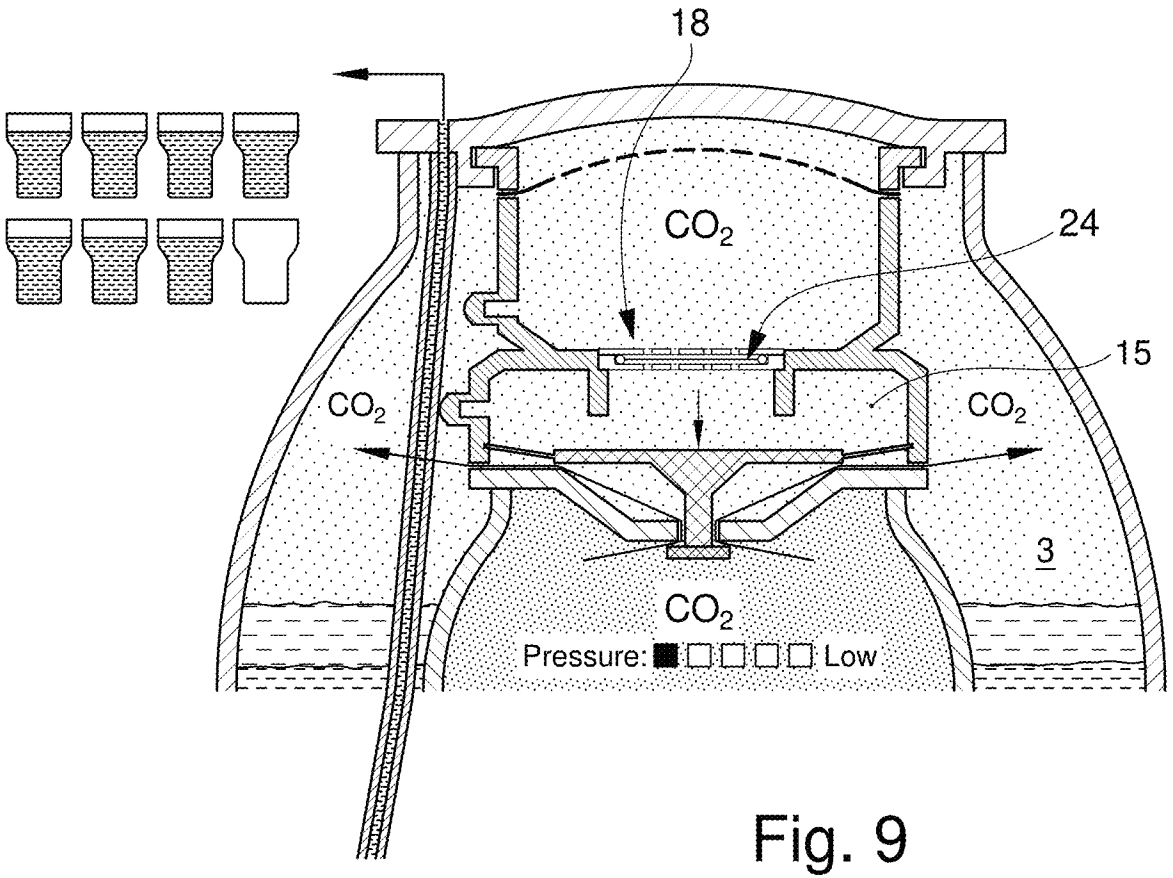

FIG. 3A-F show, schematically, in cross sectional view, steps in a method of manufacturing a pressure regulator;

FIG. 4A-C show, schematically, in cross sectional view, steps in a method for preparing a pressure regulator for use, in particular for flushing;

FIGS. 5A and B show, schematically, in cross sectional view, steps in mounting a pressure regulator in a container and closing the container;

FIG. 6 shows, schematically, in cross sectional view, a container comprising a pressure regulator, for example during transport or storage;

FIGS. 7A and B show, schematically, in cross sectional view, a container comprising a pressure regulator of the disclosure, at relatively high and relatively low temperature of the container;

FIG. 8A shows schematically a system of the disclosure during dispensing of a serving of beverage, in particular a first or at least one of the first servings;

FIG. 8B shows schematically the system of FIG. 8A, directly after closing of the valve of the gas container, shortly after closing of the draw of tap;

FIG. 9 schematically shows the system of FIGS. 8A and B, during dispensing of a serving when the container is already substantially emptied of said beverage.

Figure 11A:
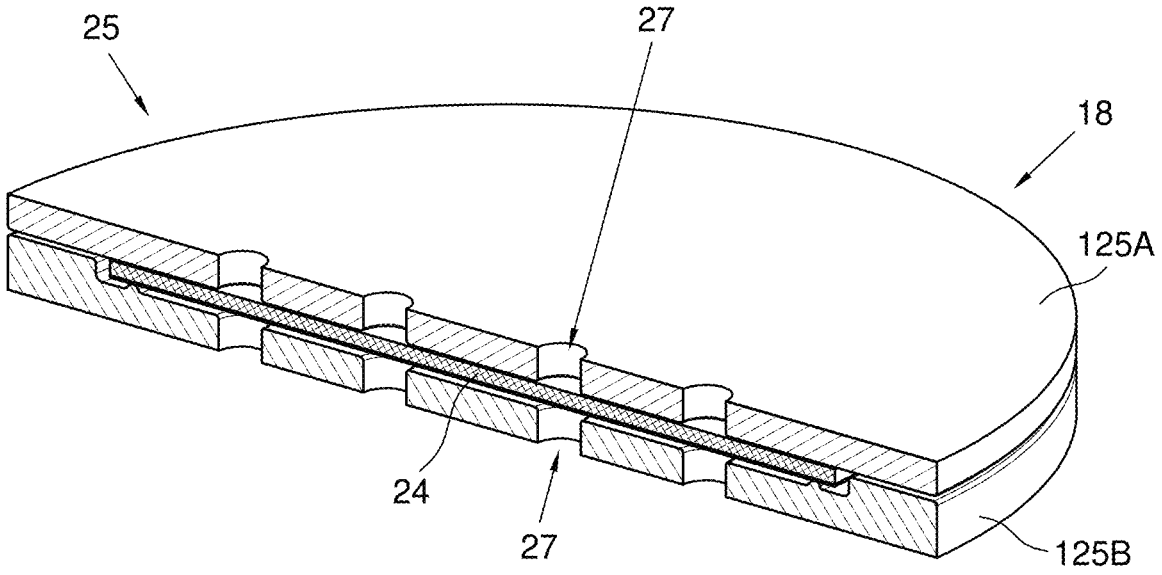
Figure 12A:
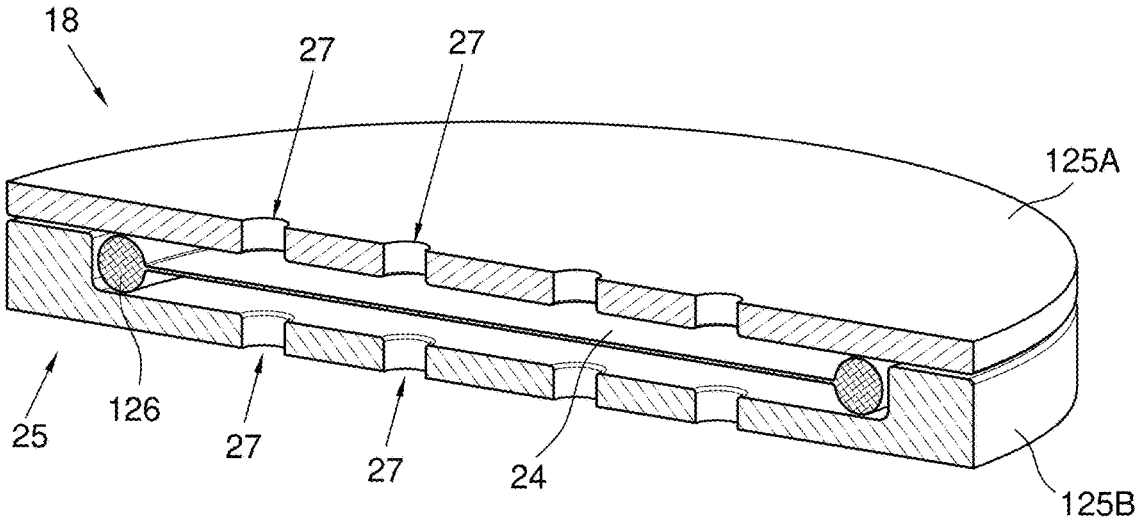
Figure 12B:
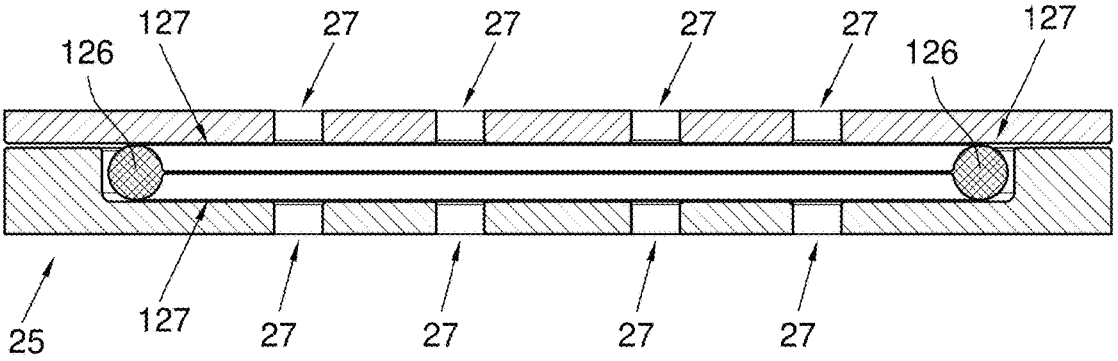
Figure 13:
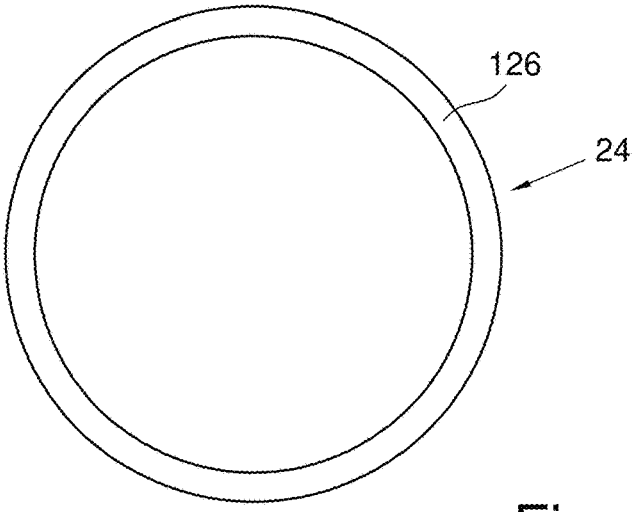
Figure 14:
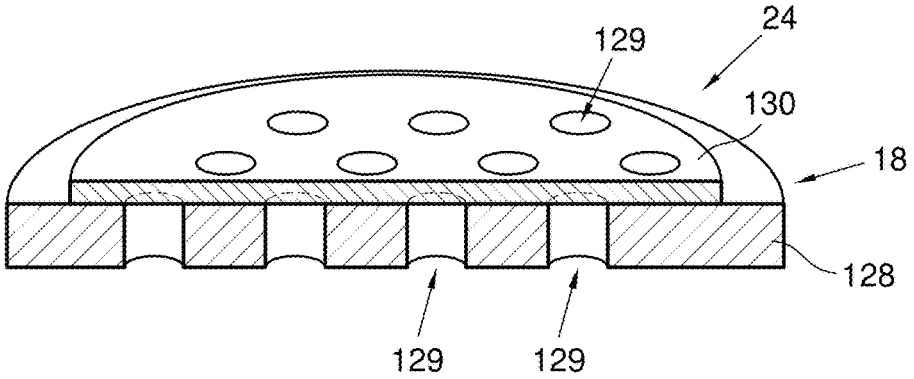
Figure 15A:
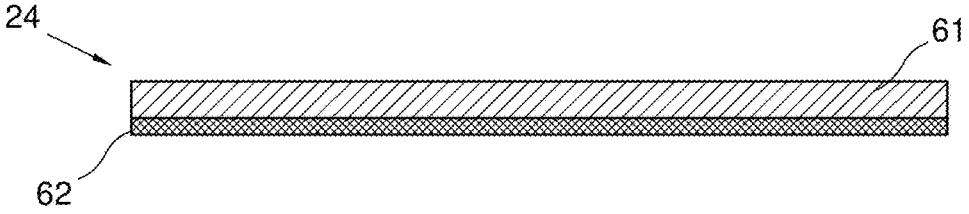
Figure 15B:
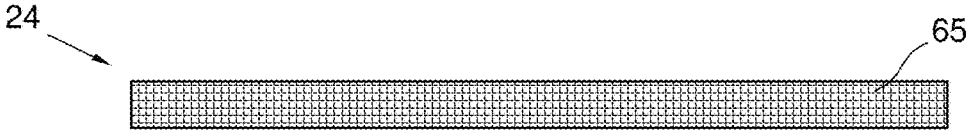
Figure 16:
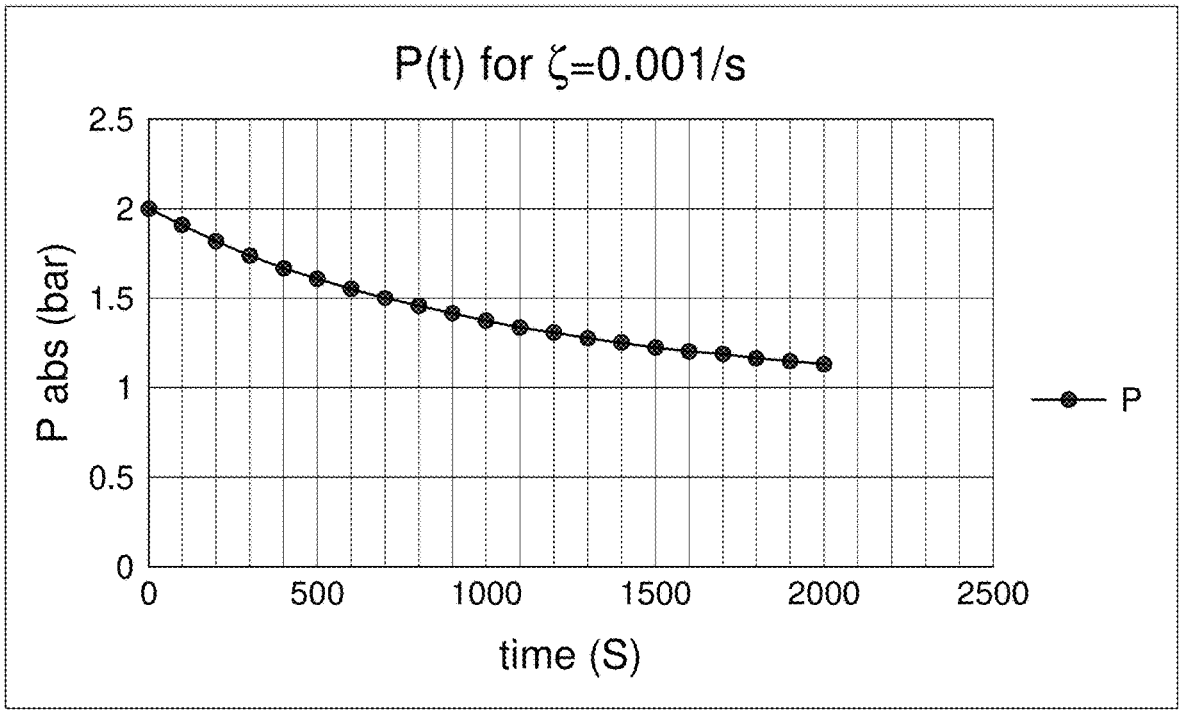

FIG. 10A-E show, schematically, in cross sectional view, different embodiments for a separating wall or wall part for a pressure regulator;

FIGS. 11A and B show, at an enlarged scale a permeable wall part construction for a pressure regulating system of the disclosure, in cross section, in perspective view and cross sectional side view;

FIGS. 12A and B show, at an enlarged scale, a further embodiment of a permeable wall part construction for a pressure regulating system of the disclosure, in cross section, in perspective view and cross sectional side view;

FIG. 13 shows in top view a permeable wall part for use in for example a structure of FIGS. 12A and B;

FIG. 14 shows in cross section schematically a further alternative embodiment of a permeable wall part for the present disclosure;

FIG. 15A shows a cross-section, similar to FIG. 12B, of another embodiment of a permeable wall part construction for a pressure regulating system of the disclosure;

FIG. 15B shows a cross-section, similar to FIG. 12B, of yet another embodiment of a permeable wall part construction for a pressure regulating system of the disclosure; and FIG. 16 shows a graph of a change of pressure prevailing in a pressure regulating chamber over time, based on a given factor $\zeta$.

In this description embodiments of beverage dispensing systems, pressure regulators, containers and pressurizing systems, as well as methods are disclosed by way of examples only. In the different embodiments the same or similar parts and features have the same or similar reference signs.

In this description embodiments of beverage dispensing systems and especially containers forming such system or forming part thereof will be disclosed, comprising a pressurizing system with which the pressure in a beverage compartment of the container can be regulated such pressurizing system may also be referred to as pressure regulator or pressure regulating system. Regulation of pressure should be understood as at least encompassing maintenance of the pressure in the beverage compartment within a predetermined pressure range, at least during periods in which no dispensing takes place. Such regulation can be obtained by a pressure regulator which operates a closure of a high pressure gas container, further also referred to simply as gas container or a first compartment, provided in or for the pressurizing system, such that when the pressure inside the beverage compartment drops the pressure regulator can open a closure of the gas container, allowing gas to flow into the beverage compartment, increasing the pressure therein. This will again operate the pressure regulator such that it will allow the closure of the gas container to close again. Such systems are well known in the art and for example disclosed in EP1064221 and WO200035774 and used in the Draught-Keg®, marketed by Heineken, The Netherlands.

In this disclosure substantially should be understood as at least meaning for the largest part or almost entirely. Small deviations of for example a given size or value or such characteristic are acceptable within the definition of substantially, such as for example deviations of less than 20%, more specifically less than 15%, more specifically less than 10%, such as for example less than 5% of a given numeric or proportional value.

In the present disclosure a pressurizing system is disclosed which has a pressure regulating chamber or second compartment, which is in communication with its surroundings, such that over a period of time an equilibrium can be obtained between the pressure inside the pressure regulating chamber or second compartment and the pressure inside the beverage compartment, by flow of gas, especially $CO_2$ gas, from the beverage compartment into the pressure regulating chamber or vice versa. The second compartment is fluid tight, such that no beverage will enter into the second compartment forming the pressure regulating chamber.

The second compartment or pressure regulating chamber is separated from the area into which the closure of the first compartment opens, such that no gas flowing from said first compartment will directly flow into said second compartment or pressure regulating chamber.

In the present disclosure flow of gas should be understood as also encompassing passing of a gas through a permeable wall part, for example by diffusion or migration.

In this disclosure a gas permeable wall part should be understood as a wall part comprising one or more layers of material allowing gas to pass through but preventing fluids such as beer or foam to pass through. A permeable wall part for use in the present disclosure preferably is especially adapted to allow gas used for pressurizing a beverage to pass through it, such as for example $CO_2$ gas or $N_2$ gas when used for carbonated beverages such as beer. In embodiments a permeable wall part can be permeable for $CO_2$ gas but not for oxygen. A permeable wall part for use in the present disclosure can for example be permeable for gas due to a pressure difference over said permeable wall part and/or due to a partial pressure difference over said permeable wall part, for example because of different concentrations of the relevant gas on opposite sides of the permeable wall part.

A permeable wall part for use in the present invention may be hydrophobic, such that a fluid on the permeable wall part will substantially not form a closed film but separate droplets on the surface of the permeable wall part, preferably such that a surface angle between the surface and the droplet will be larger than 90 degrees.

A preferred embodiment includes a silicone permeable wall, e.g. a hydrophobic silicone permeable wall.

In this disclosure a permeable wall part preferably has a stiffness or is provided with a frame or such support providing for a stiffness such that the permeable wall part will substantially not deflect or otherwise deform under influence of a pressure regulating pressure inside the second compartment 15 or in the beverage compartment 3 (and in particular under influence of a pressure difference over the permeable wall). Preferably such that a change of pressure inside the pressure regulating chamber will only deform and/or move the movable and/or deformable wall part, as will be discussed.

In this disclosure a separating wall or separating wall part, especially a wall part formed by or comprising a permeable wall part should be understood at least as meaning a wall or wall part separating a second compartment from an environment of the pressure regulator, especially from a beverage compartment when placed in or in contact with a beverage compartment of a beverage container. Separating should be understood at least as meaning preventing beverage or foam from entering into the second compartment. The separating wall is gas permeable, such that the pressure can be regulated in said second compartment by gas passing through said separating wall or wall part.

This can mean that when the pressurizing device is under atmospheric pressure, e.g. outside the beverage container or prior to filling of the beverage container, the pressure inside the pressure regulating chamber of the pressure regulator will be atmospheric too, and thus the closure of a gas container connected to the pressure regulator will be closed and the pressurized gas inside the gas container will stay in said gas container. After filling of the beverage container with a carbonated beverage such as beer and closing the beverage compartment, the pressure inside the beverage compartment will be above atmospheric and thus the pressure regulator will be inactive in the sense that the closure of the gas container will be closed. $CO_2$ gas contained in the carbonated beverage will act to such extend that it will provide that the pressure inside the pressure regulating chamber will become about the same as the pressure in the beverage compartment. Thus the pressure regulator becomes activated, meaning that a relatively quick pressure drop in the beverage compartment, especially due to dispensing of a quantity of beverage therefrom, will lead to the pressure regulator opening the closure of the first compartment or gas container, for compensation of the pressure drop due to the dispensing, by feeding gas from the gas container into the beverage compartment until the desired gas pressure inside the beverage compartment has been reached again. Since the gas can only slowly flow into and/or out of the pressure regulating chamber, through the permeable wall part, during the pressure drop in the beverage compartment due to the dispensing of beverage, the pressure inside the regulating chamber will be maintained at substantially the same level, thus keeping the pressure regulator active and operative to open the closure of the gas container.

In a pressure regulator system of the disclosure the second compartment preferably has a separating wall or wall part, allowing for gas to pass into and/or out off the second compartment, especially at least $CO_2$ gas.

The possibility that over a period of time an equilibrium can be obtained between the pressure inside the second compartment, forming a pressure regulating chamber, and the pressure inside the beverage compartment, by flow of gas, especially $CO_2$ gas, into the second compartment or out of it, can also have the advantageous effect that a temperature change in the system, especially of the beverage, can be followed by the pressure regulator. For example after filling of the beverage container the temperature of the beverage may rise, for example during transport and storage, in a store or at a consumers place. This will lead to an increase of pressure in the beverage compartment. Since in a system according to the present disclosure gas can pass through the permeable wall part into and/or out of the second compartment during cooling of the beverage, the pressure inside the pressure regulating chamber will easily follow the pressure reduction in the beverage compartment, by gas flowing out of the regulating chamber, without significantly increasing pressure in the beverage compartment. Similarly, when the temperature of the beverage would rise again, the pressure inside the pressure regulator chamber will also follow a pressure rise inside the beverage compartment due to a temperature change easily and automatically.

In a pressure regulator possible gas flow debit through the permeable wall part is limited, such that it will take a significantly longer time for reaching a pressure equilibrium than the time necessary for dispensing of a serving of beverage. Hence dispensing a serving of beverage, such as for example about 100 cl or more, will allow the movable and/or deformable wall or wall part of the second compartment to allow a volume increase of the second compartment, opening the valve of the first compartment for raising the pressure again inside the beverage compartment. A relatively quick pressure increase inside the beverage compartment will on the other hand first increase the pressure inside the second compartment, reducing the volume thereof. Then gas may pass slowly into or out of the second compartment, such that over time again a pressure equilibrium will be obtained.

In a system according to the present disclosure the pressure inside the pressure regulating chamber, referred to also as the regulating pressure, will fluctuate with temperature changes in the container to such extend that the regulating pressure will at different temperatures be in line with the equilibrium pressure of the beverage, which is the pressure at a given temperature at which the gas content of the beverage will be maintained at a desired, predetermined level. Thus at such equilibrium pressure at the given temperature the saturation of gas in the beverage will be maintained at said predetermined, desired level, for example the level of the beverage as original produced. For different temperatures the equilibrium pressure will be different and the regulating pressure will automatically be adapted to that changed pressure.

In the present disclosure a permeable wall part should be understood as providing a gas connection which allows gas to flow either way between said second compartment and its surroundings, for substantially obtaining an equilibrium in pressure between the pressure regulating chamber and the beverage compartment over a period of time.

In the present disclosure a period of time referred to with respect to the period in which gas can flow into or out of the pressure regulating chamber should be understood as a period relatively long compared to the period in which a serving of beverage is dispensed from the beverage compartment. Such serving can for example contain about 0.2 to 0.5 liter or for example about a pint, which will be dispensed within about a minute (e.g. about 10 to 60 seconds, depending on the serving volume). The period of time as indicated over which pressure equilibrium can be reached will in such circumstances be a multiplicity of such dispensing time, for example minutes to tens of minutes, i.e. long enough to maintain the regulating pressure in the pressure regulating chamber during the dispensing of said serving or even several such servings. The regulating pressure in this respect should be understood as meaning the pressure prevailing inside the pressure regulating chamber directly prior to said dispensing of such serving.

A pressure regulating system according to the disclosure will react to a sudden drop in pressure, since then the valve of the gas container will be opened for supplying gas into the beverage compartment, but almost not to sudden pressure increases, since this will only push the movable or deformable wall further into the pressure regulating chamber, compressing the gas therein.

Figure 1B:
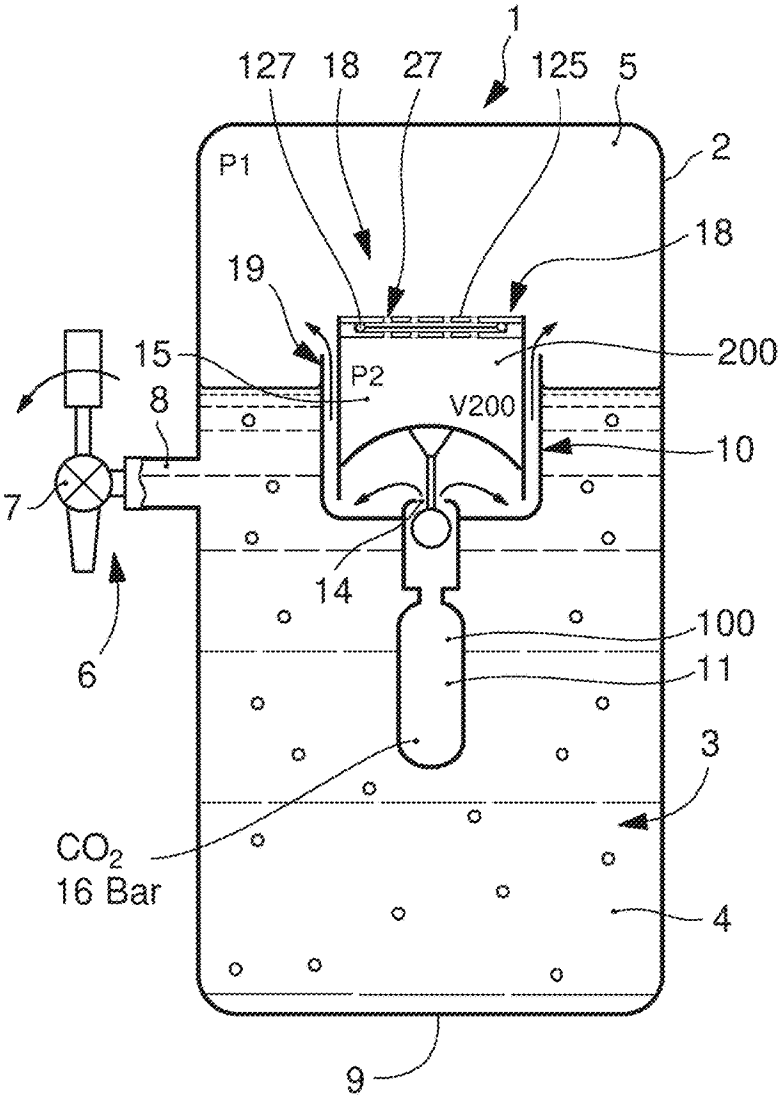
FIGS. 1A and 1B show, schematically, a container or beverage dispensing system according to the disclosure, with a first embodiment of a pressurizing device in a rest position and during dispensing respectively.
Figure 1A:
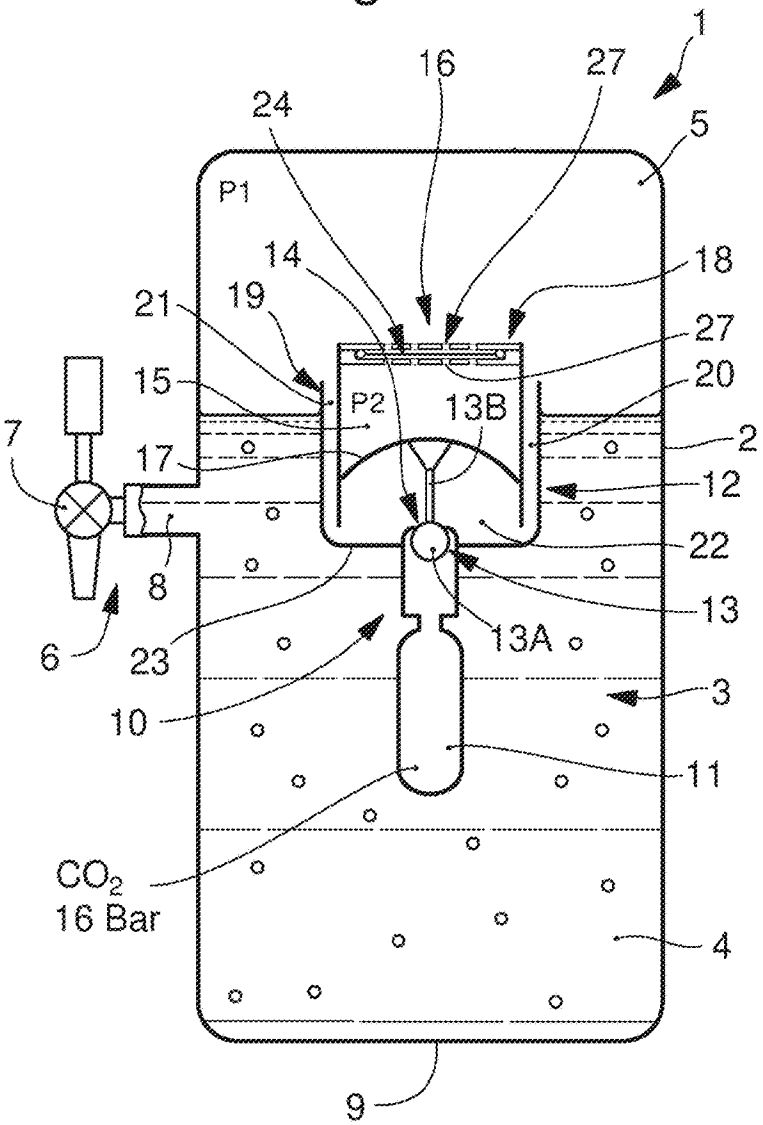
Figure 2:
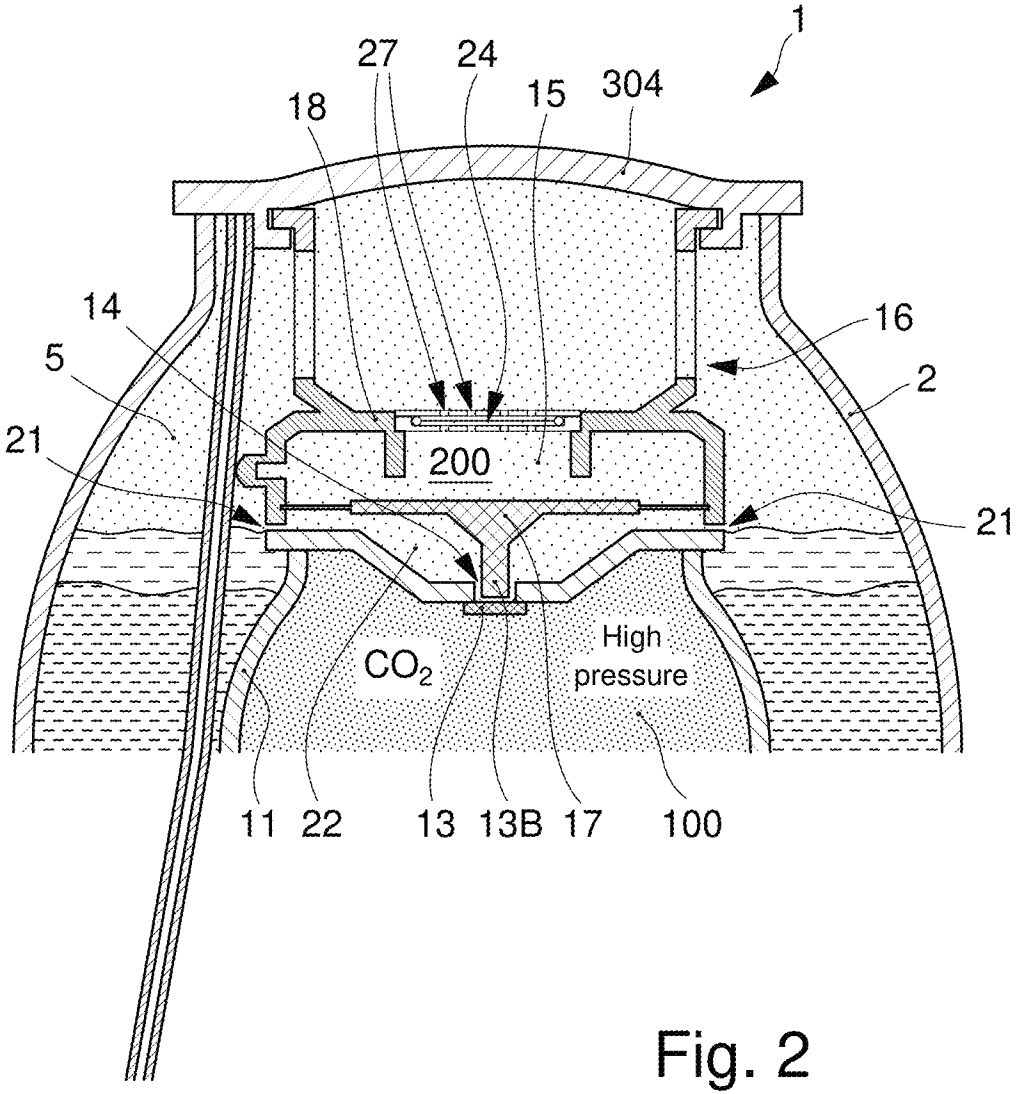
FIG. 2 shows, schematically, part of a container or beverage dispensing system according to the disclosure, in an embodiment.

FIGS. 1 and 2 show an embodiment of a container 2 forming a beverage dispensing system 1 or part thereof, especially for carbonated beverages such as beer. However, also non-carbonated beverages could be dispensed with such system. The container 2 comprises a beverage compartment 3 at least partly filled with a carbonated beverage such as beer 4. A head space 5 is provided above the beverage 4, filled with gas, in the embodiment shown $CO_2$ gas. For different beverages this could however be a different gas, such as for example but not limited to nitrogen gas, air, oxygen or the like, or a gas mixture of such gasses. Schematically a dispensing provision 6 is shown, comprising a tap 7 connected to an outlet 8. A dip tube can be connected to the outlet 8, extending to close to the bottom 9 of the container 2, in a known manner. Any suitable dispensing provision known can be used with a system 1 of this disclosure with which beverage can be dispensed from the beverage compartment 3. The dispensing provision can be provided in any suitable position.

Inside the container 2, especially in the beverage compartment 3, a pressurizing system 10 is provided, comprising a gas container 11 and a pressure regulator 12. A valve system 13, further also referred to as closure, is provided for closing an outlet 14 of the gas container 11. The gas container 11 is or comprises a first compartment 100 filled with pressurized gas such as $CO_2$ gas, for example initially at a pressure of several bar absolute (1 bar=100 kPa). For example but not limited to above 10 bar, for example about 16 bar or even higher. The amount of gas contained in the gas container 11 is preferably sufficient for dispensing the entire content of beverage from the container 2. A gas adsorbing and/or absorbing material, such as but not limited to active coal may be provided inside the gas container 11, as is known in the art.

The pressure regulator 12 is operative for opening the closure 13 and comprises a pressure regulating chamber 15 in a housing 16. The pressure regulating chamber forms a second compartment 15. The housing 16 at the side of the gas container 11 is provided with a wall part 17 forming part of the wall 18 of the pressure regulating chamber 15. In this embodiment the wall part 17 is a deformable wall part 17, such as a diaphragm. Alternatively or additionally the wall part 17 can be a movable wall part such as a piston, sealing against an inside of the wall 18 for forming a pressure regulating chamber 15 of which the internal volume can change, as will be discussed. Connected to the gas container 11 is an outer housing part 19, open towards the head space 5, in the embodiment shown at a side opposite the gas container 11. The outer housing part 19 in this embodiment has a peripheral wall 20 surrounding the wall 18 of the pressure regulating chamber 15. Between the peripheral wall 20 and the wall 18 at least one channel 21 is provided, forming an outlet opening, connecting the head space 5 with a outlet space 22 enclosed between the wall part 17 and a bottom 23 of the outer housing part 19. The at least one channel 21 is such that the gas pressure $P_1$ prevailing inside the head space 5 will be substantially the same as the pressure in said gas space 22, acting on one side of the wall part 17.

In embodiments the outer housing part 19 can be eliminated in part or entirely, such that the outlet space is part of or formed by the beverage compartment 3 itself.

In the pressure regulating chamber 15 a second pressure $P_2$ will be present, acting on the opposite side of the wall part 17, that is the side facing inward to the pressure regulating chamber 15.

A part of the wall of the second compartment or pressure regulating chamber 15 is formed by or comprises at least one permeable wall part 24. The permeable wall part is permeable for gas, especially $CO_2$ gas, but not for liquid such as a beverage, e.g. beer, or foam thereof. The permeability of the permeable wall part is preferably restricted such that a sudden movement of the wall part 17 into said housing 16, reducing the volume V of the chamber 15, or in opposite direction, increasing the volume V of the chamber 15, will lead to a pressure change inside the pressure regulating chamber or second compartment 15, due to the fact that gas cannot flow into or out of the pressure regulating chamber 15 through said permeable wall part 24 quickly enough to prevent such pressure change, whereas over a longer period of time a pressure equilibrium can be obtained.

Figure 11B:
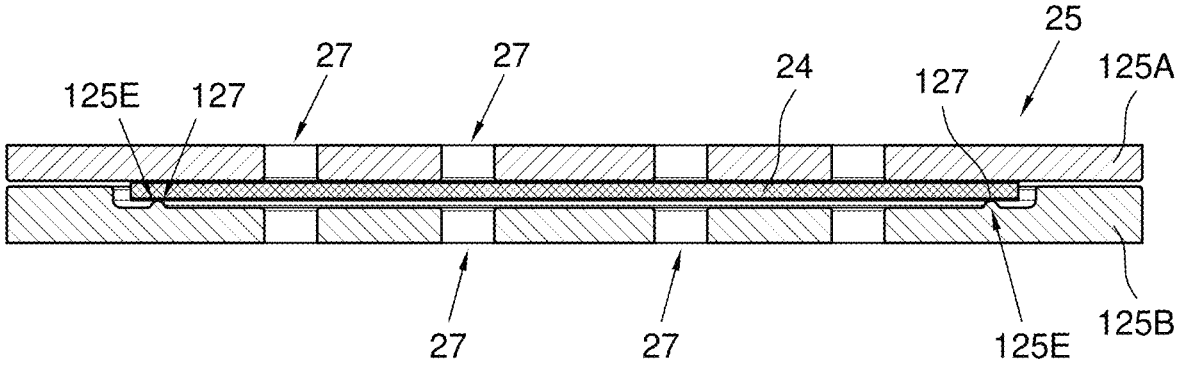

As discussed the or each permeable wall part 24 is preferably relatively stiff, such that it will not significantly deform when the pressure inside the pressure regulating chamber 15 changes (that is: when there is a pressure difference over the permeable wall). The permeable wall part(s) to that end can have its own intrinsic stiffness due to for example choice of material and/or dimensions and/or permeable wall part design. Additionally or alternatively the permeable wall part 24 can be provide with a support structure 25, as schematically shown in FIG. 11-13 providing for the desired stiffness. Such support structure can for example be integrated into the permeable wall part, for example as a layer of the permeable wall part 24, such as for example a filter, a mesh or a cell foam, as for example shown in FIG. 11-14. Additionally or alternatively the support structure can be or comprise for example a wall part 26 of the second compartment 15, provided with one or more relatively large openings 27 which are closed off by the permeable wall part(s) 24, as shown in fig. FIG. 11-13. The permeable wall part 24 or the permeable wall part 24 together with the support structure 25 preferably has a stiffness comparable to a stiffness of the wall 18, 19 of the second compartment 24.

In exemplary embodiments the permeable wall part 24 can be a multi layered structure, as schematically shown in FIG. 15A in cross-sectional view, comprising at least a first layer 61, for example formed by a woven or non-woven, layer of a mesh, an open cell foam or the like, through which gas can permeate, wherein in a non-limiting embodiment the respective permeation can be for example at a rate of 1050 and 4000 barrer. In particular, a respective permeation provided by the first layer 61 can be at a rate that is significantly higher than a permeation rate provided by a second layer 62. This second layer 62 can be provided on the first layer 61 (see the drawings), which second layer 62 can for example be a different material, for example a silicon layer, a hydrophobic layer, such as but not limited to a hydrophobic silicon layer, the second layer 62 not blocking said permeability of the permeable wall part for said gas, but preventing liquid from blocking the permeability of the permeable wall part 24.

In embodiments, as schematically shown in FIG. 15B, the permeable wall part 24 can be formed by a (single) layer of material 65, such as for example a mesh or open cell foam or grid or other known gas permeable material, which has been coated with and/or impregnated with a coating material, such as a silicon based material. For example a spray or dip coating material.

In the embodiment of FIGS. 1 and 2 the closure 13 is provided comprising an element 13A connected to the wall 17 by a stem 13B, forming a valve. The element can for example be a disc, a cone or a ball or any other body suitable for opening and closing the outlet 14. If the pressure difference over the wall 17 is such that the stem 13B is moved up in FIG. 1 or 2, the element 13A will be forced into the outlet 14, closing the outlet 14. Preferably said element 13A is not physically connected to the stem 13B, such that the stem 13B can for example travel further upward in FIGS. 1A and B than the element 13A, the stem 13B temporarily losing contact with said element 13A. If however the pressure difference over the wall 17 is such that the stem 13B is moved down in FIG. 1 or 2, the element 13A will be forced out of the outlet 14, opening the outlet 14. The wall 17 may be formed or tensioned such that it biases the element 13A into the outlet 14 when there is no pressure difference over the wall 17, especially at atmospheric pressure, for maintaining the outlet closed prior to activation. Obviously other valves can be used in stead, such as an aerosol valve or valves as disclosed in the prior art referred to in the introduction to this specification. The element 13A can be biased into the closed position.

In FIG. 1A the container is shown in rest, i.e. the dispensing provision 6 is closed and no beverage is being dispensed. In the beverage compartment 3 and especially in the head space 5 the first pressure $P_1$ prevails, whereas in the chamber 15 the second pressure $P_2$ prevails. If $P_1$ and $P_2$ are not the same, for example because the container 2 has just been filled and closed, or the beverage is being or has been cooled or heated, compensation will occur over a period of time, such that after such time the pressures $P_1$ and $P_2$ will become the same. For example, if $P_1$ is higher than $P_2$, gas will pass into the pressure regulating chamber 15, whereas if $P_2$ is higher than $P_1$ gas will pass in the opposite direction, out of the pressure regulating chamber 15. Thus an equilibrium will be obtained between these pressures.

In this disclosure a pressure regulating chamber is considered the chamber 15 in which a regulating pressure prevails, at least partly defined by the movable and/or deformable wall 17 and containing substantially only gas, separated from the beverage compartment and beverage contained in said beverage compartment. Hence the pressure regulating chamber will be substantially and preferably entirely free of beverage. The pressure regulating chamber 15 has walls such that a change in volume is only obtained by deformation and/or displacement of the movable and/or deformable wall 17.

Since after filling and closure of the container 2 a relatively long period will be available before the container is used for dispensing, due to at least transport to for example a store, bar or consumer, the period for obtaining such equilibrium may be relatively long, for example hours or even days. Similarly, since cooling or heating of the beverage will not be sudden but will take tens of minutes to several hours, depending on for example the volume and relevant temperature differences, again the period of time over which the gas may pass into and/or out of the pressure regulating chamber 15 can be relatively long, for example minutes to hours.

In FIG. 1B the container 2 is shown during dispensing of a serving of beverage 4. In this stage the tap 7 is opened long enough to dispense a serving of beverage 4 from the container 2 into for example a glass (not shown). During the period of dispensing the pressure $P_1$ will drop relatively quickly. Since the pressure $P_2$ in the pressure regulating chamber 15 during this relatively short period of dispensing (as mentioned above) will not change significantly, the pressure difference over the wall 17 will force the stem 13B in the direction of the gas container 11, thus opening the valve and allowing gas under pressure to leave the gas container 11 through the opening 14 and into the outlet space 22, from which it will flow into the head space 5 and beverage compartment 3, increasing the pressure therein back to the desired starting pressure $P_1$. When the pressure $P_1$ is back at the desired pressure the wall 17 will allow the valve to close again.

As discussed, since the passing of gas through the at least one permeable wall part 24 into or from the pressure regulating chamber 15 is relatively slow compared to the flow of the beverage during dispensing and the supply of gas from the first compartment 100 into the beverage compartment 3, the regulating pressure $P_2$ in the chamber 15 will change little to nothing during such dispensing period, other than by the relatively small movement and/or deformation of the wall 17. The movement and/or deformation of the wall part 17 will be so small that the increase or decrease of volume therein will hardly influence the pressure $P_2$. Thus the desired regulating pressure and a given temperature will mainly be maintained.

In a pressure regulating device 10 of the present disclosure the regulating pressure is not a fixed pressure but a pressure which will be set dependent on the equilibrium pressure of the beverage to be dispensed, basically irrespective of the temperature of the beverage. The amount of gas leaving the beverage inside the container during a given period of time will be equal to the amount of gas (re)entering said beverage, maintaining the level of saturation of the beverage. Due to the at least one permeable wall part 24 a change in the equilibrium pressure due to a temperature change in the beverage will also be followed by the regulating pressure in the pressure regulating chamber 15 and thus the pressure regulator system will maintain the desired equilibrium pressure of the beverage at the different temperatures.

Without wanting to be bound to any theory, it appears that by providing the permeable wall part, especially a hydrophobic permeable wall part, the pressure regulator 12 of the present disclosure provides for a better control of regulating pressure because the beverage and foam of the beverage are prevented from blocking the permeable wall part 24.

Additionally or alternatively the at least one permeable wall part can be formed in or as a porous body allowing gas to pass through it, such as but not limited to an open cell foam material.

The or each outlet channel or opening 21 connecting the outlet space 22 with the beverage compartment 5 may be provided at any level either in or above the beverage. The pressure device 10 may be oriented different from the position as shown in the drawings, for example with the pressure regulator 12 facing downward or to a side relative to the first compartment 100.

The aim of the permeable wall part 24 is to provide for passing of gas from the second compartment 15 into its surrounding or vice versa relatively slowly, compared to a relatively sudden change in pressure and/or volume of the second compartment 15 by movement and/or deformation of the wall 17 due to for example a serving of beverage being dispensed from the beverage compartment 3. The at least one permeable wall part 24 hence provides for a time lag in compensation for the relatively sudden change in pressure and/or volume of the second compartment 15 by adding gas to or removing gas from the second compartment and/or for allowing adjustment of a regulating pressure $P_2$ in the second compartment 15 based on a pressure $P_1$ in the beverage compartment without opening the outlet 14.

In FIG. 2 schematically part of an alternative embodiment is shown of a container 1 of the present disclosure, in which the same or similar elements are referred to using the same or similar reference signs as used in FIG. 1. In this embodiment a pressure regulator 12 is suspended inside a beverage compartment 3 of a container 1 by a lid or closure 304 connected to an opening in the top of the container, for example a neck area thereof. The gas container 11 or first compartment 100 is connected to the opposite end of the pressure regulator, here shown as the lower end. In this embodiment the housing 16 can for example be made of plastic, for example by moulding in one piece, comprising the walls for the second compartment 15. The movable or deformable wall or wall part 17 is shown as a diaphragm 17 with a central portion 17A being thicker than a peripheral portion 17B connected to the wall 19 of the second compartment 15, closing off the pressure regulator chamber 15 towards the outlet space 22.

Figure 2A:
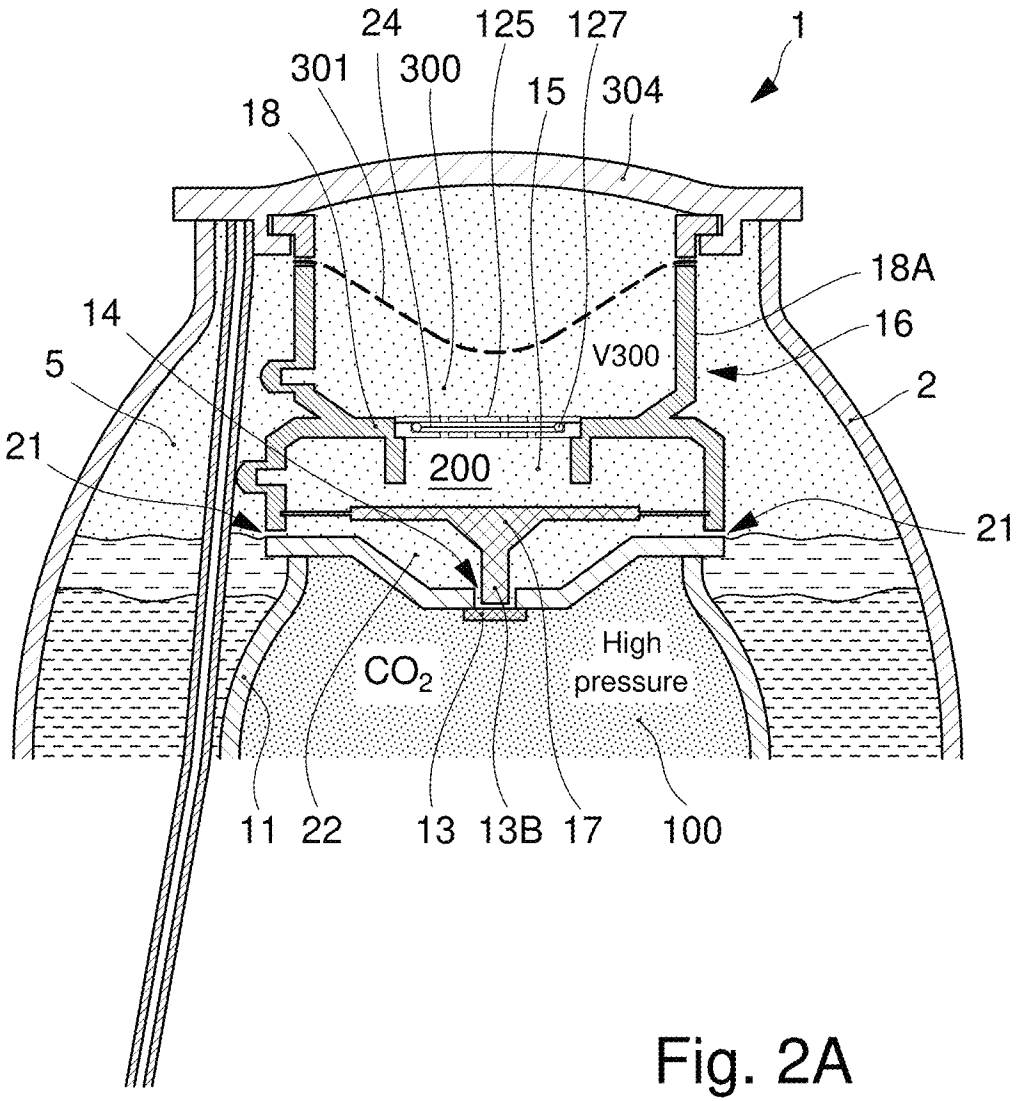
FIG. 2A shows, schematically, part of a container or beverage dispensing system according to the disclosure, in an embodiment similar to e.g.

In embodiments a third compartment 300 can be connected to or provided in the pressure regulator, extending over the permeable wall part 24, such that gas can pass through the permeable wall part 24 from the pressure regulating chamber 15 into the third compartment 300 and vice versa, wherein the third compartment is separated from the beverage compartment 3 at least by a separating wall 302, as shown in FIG. 2A.

In this disclosure a separating wall or separating wall part should be understood at least as meaning a wall or wall part separating a third chamber from an environment of the pressure regulator, especially from a beverage compartment when placed in or in contact with a beverage compartment of a beverage container. Separating should be understood at least as meaning preventing beverage or foam from entering into the third compartment, also referred to as third chamber. The separating wall is preferably at least movable, deformable and/or gas permeable, such that the volume of the third chamber is adjustable and/or pressure can be regulated in said third chamber by at least said separating wall or wall part.

This can mean that when the pressurizing device is under atmospheric pressure, e.g. outside the beverage container or prior to filling of the beverage container, the pressure inside the pressure regulating chamber of the pressure regulator will be atmospheric too, and thus the closure of a gas container connected to the pressure regulator will be closed and the pressurized gas inside the gas container will stay in said gas container. The pressure in the third compartment will also be atmospheric. After filling of the beverage container with a carbonated beverage such as beer and closing the beverage compartment, the pressure inside the beverage compartment will be above atmospheric and thus the pressure regulator will be inactive in the sense that the closure of the gas container will be closed. $CO_2$ gas contained in the carbonated beverage will act on a pressure regulating wall or wall part of the third compartment, to such extend that it will provide that the pressure inside the pressure regulating chamber will become about the same as the pressure in the beverage compartment. Thus the pressure regulator becomes activated, meaning that a relatively quick pressure drop in the beverage compartment, especially due to dispensing of a quantity of beverage therefrom, will lead to the pressure regulator opening the closure of the first compartment or gas container, for compensation of the pressure drop due to the dispensing, by feeding gas from the gas container into the beverage compartment until the desired gas pressure inside the beverage compartment has been reached again. Since the gas can only slowly flow into and/or out of the pressure regulating chamber into the third compartment, during the pressure drop in the beverage compartment due to the dispensing of beverage the pressure inside the regulating chamber will be maintained at substantially the same level, thus keeping the pressure regulator active and operative to open the closure of the gas container.

In a pressure regulator system of the disclosure comprising a third compartment, also referred to as third chamber, the third chamber preferably has a separating wall or wall part, allowing for an increase or decrease of the volume of the third compartment. Preferably the volume of the third compartment can change such that an amount of gas or gas mixture can be introduced into or removed from said third compartment without a significant change in the pressure in the third compartment or at least resulting in a pressure change significantly smaller than a pressure change which would occur when the same amount of gas or gas mixture would be brought into a compartment have a fixed volume of about the same size as the third compartment having a volume central between a maximum and minimum volume, which can also be referred to as an average volume (minimal volume+(maximum volume−minimum volume)/2). In embodiments the pressure regulating wall or wall part can be designed such that when used in a beverage container containing a pressurized beverage the pressure regulating system will drive to an equilibrium pressure situation wherein there is no significant difference in pressure between the pressure in the third compartment and the pressure in the beverage compartment of the container containing the beverage. No significant pressure difference should preferably be understood as a pressure difference of no more than 15%, preferably no more than 10%, more preferably no more than 5% pressure difference between the said pressures, especially when measured when the pressure in the second and the pressure in the third compartment is the same. By way of example, which should not be considered limiting the scope of the disclosure, if the beverage is a beverage, for example beer, at an absolute pressure of 1.6 bar, the pressure difference between the third compartment and the pressure in the beverage compartment (1.6 bar absolute) may be less then 0.4 bar, preferably less than 0.16 bar, more preferably less than 0.08 bar.

The possibility that over a period of time an equilibrium can be obtained between the pressure inside the second compartment, forming a pressure regulating chamber, and the pressure inside the third compartment, and hence in the beverage compartment, by flow of gas, especially $CO_2$ gas, from the third compartment into the second compartment or vice versa, can also have the advantageous effect that a temperature change in the system, especially of the beverage, can be followed by the pressure regulator. For example after filling of the beverage container the temperature of the beverage may rise, for example during transport and storage, in a store or at a consumers place. This will lead to an increase of pressure in the beverage compartment. Since in a system according to the present disclosure gas can flow between the third compartment and the second compartment during cooling of the beverage, the pressure inside the pressure regulating chamber will follow the pressure reduction in the beverage compartment, by gas flowing out of the regulating chamber into the third compartment until equalizing the pressure in the regulating chamber and the beverage compartment. Similarly, when the temperature of the beverage would rise again, the pressure inside the pressure regulator chamber will also follow a pressure rise inside the beverage compartment due to a temperature change automatically.

In a pressure regulator comprising such third compartment 300, possible gas flow debit is limited between the second and third compartment, as it is in the embodiments without a third compartment between the pressure regulating chamber and the beverage compartment 3. The debit is such that it will take a significantly longer time for reaching a pressure equilibrium than the time necessary for dispensing of a serving of beverage. Hence a dispensing a serving of beverage will allow the movable and/or deformable wall or wall part of the second compartment to allow a volume increase of the second compartment, opening the valve of the first compartment for raising the pressure again inside the beverage compartment. A relatively quick pressure increase inside the beverage compartment will on the other hand first increase the pressure inside the second compartment, reducing the volume thereof. Then gas will flow slowly out of the second compartment into the third compartment, without increasing pressure inside the third compartment significantly, such that overtime again a pressure equilibrium will be obtained.

In the present invention the permeable wall part 24 can hence allow gas to pass through it between the pressure regulating chamber 15 and the beverage compartment 3 or between the pressure regulating chamber 15 and the third compartment 300, if provided for.

The third compartment 300 is preferably fluid tight, as is the second compartment or pressure regulating chamber 15, meaning that the beverage cannot pass into said compartments, nor foam thereof. The third compartment 300 can have the wall 18 as a bottom wall and a peripheral wall 18A extending therefrom. In the embodiments shown the third compartment is closed by a separating wall or wall part 301. In embodiments the separating wall or wall part 301 can be designed to allow changes of the internal volume $V_{300}$ of the third compartment. In embodiments the separating wall or wall part 301 can allow gas to pass in to and out from the third compartment from or to the beverage compartment substantially freely. In such embodiments the said wall or wall part 301 can for example be formed of or comprise a gas permeable but beverage tight membrane, such as but not limited to a semi permeable membrane, for example Goretex®.

In the embodiment shown in FIGS. 2A and 3 the separating wall 301 is formed substantially by a foil, especially a relatively thin, flexible foil. The foil can for example be a thin plastic foil, such as but not limited to a PE based foil. Foil should in this disclosure be understood as at least meaning a film or sheet of material, flexible and having a small thickness compared to a length and width direction perpendicular to each other and to the thickness. Alternative embodiments are shown for example in FIG. 10. The separating wall or wall part 301 will allow for a change in volume $V_{300}$ of the third compartment substantially without a change in the pressure prevailing therein. During use in a rest position, during which the temperature of the beverage stays substantially the same and no beverage is dispensed, preferably a pressure difference over the separating wall 301 is maintained preferably below 15000 Pascal, preferably less than 10000 Pascal (100 mbar), more preferably less than 7500 Pascal (75 mbar), such as for example about 5000 Pascal (50 mbar) or less.

In embodiments the foil forming the separating wall 301 can have a surface area larger than the opening 312 defined by the peripheral wall 18A, such that the internal volume $V_{300}$ of the third compartment 300 can increase or decrease without stretching the foil.

In FIG. 2A the container is shown in rest, i.e. the dispensing provision 6 is closed and no beverage is being dispensed. In the beverage compartment 3 and especially in the head space 5 the first pressure $P_1$ prevails, whereas in the chamber 15 the second pressure $P_2$ prevails. In the third compartment a pressure $P_3$ will prevail. If $P_1$ and $P_2$ are not the same, for example because the container 2 has just been filled and closed, or the beverage is being or has been cooled or heated, compensation will occur over a period of time, such that after such time the pressures $P_1$ and $P_2$ will become the same. For example, if $P_1$ is higher than $P_2$, gas will flow from the third compartment 300 into the chamber 15, whereas if $P_2$ is higher than $P_1$ gas will flow in the opposite direction, from the chamber 15 into the third compartment 300. Thus an equilibrium will be obtained between these pressures. In an equilibrium situation the pressure $P_3$ will be substantially the same as the pressures $P_1$ and $P_2$.

In FIG. 3A-F steps are disclosed in a method for manufacturing a pressure regulator 12 according to the disclosure.

Figure 3B:
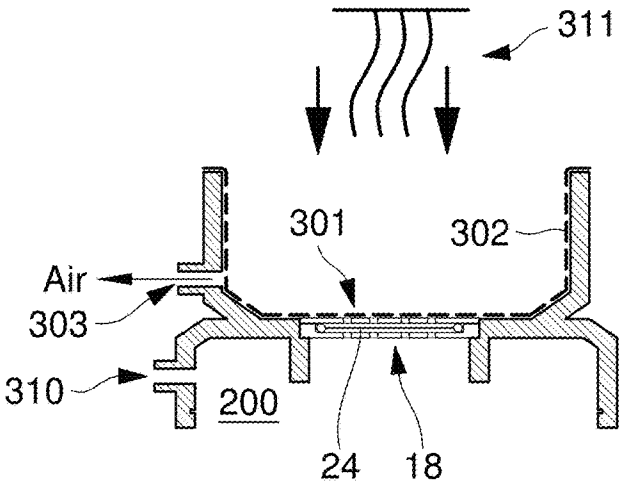
Figure 3D:
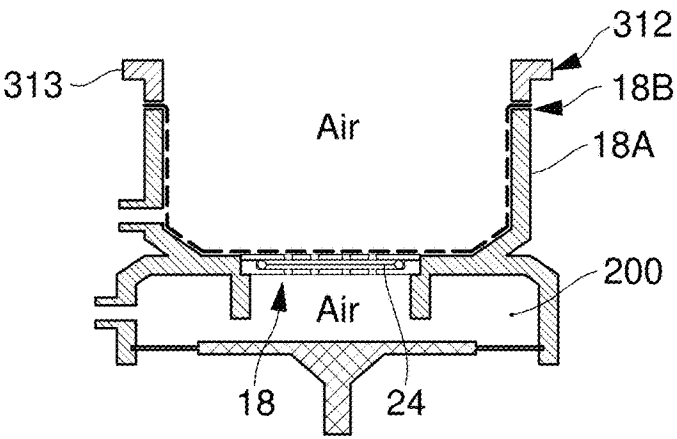
Figure 3A:
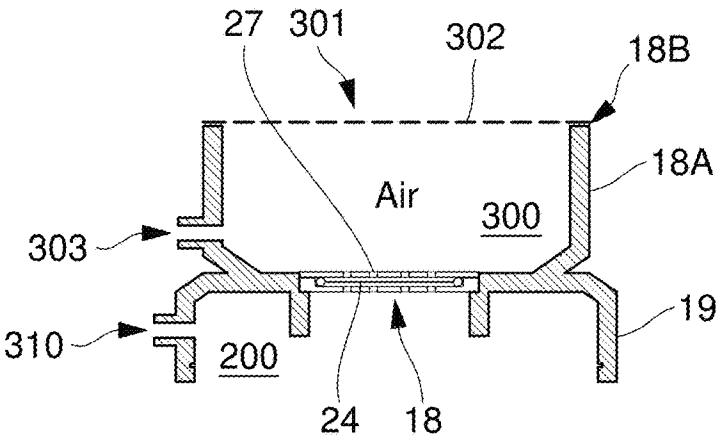

In FIG. 3A a pressure regulator housing is shown, schematically in cross section, comprising the base wall 18 comprising the permeable wall part 24, the peripheral wall 18A for enclosing the third compartment 300 and the peripheral wall 19 for enclosing the second compartment 15. A foil 302 for forming the separating wall 301 is mounted on a top edge 18B of the peripheral wall 18A. This can be connected in a sealing manner by any suitable means, such as for example by welding, such as ultrasonic welding, by glue or heats sealing or the like. The third compartment 300 thus has an open upper end closed by a foil 302 forming a preform for a separating wall 301. The foil 302, here shown by a striped line, is fluid tight and flexible. The foil is for example a vacuum formable plastic film or sheet, connected to the peripheral wall 18A in any suitable, sealing manner, for example by welding. In the position shown in FIG. 3A the foil 302 is substantially flat. In the peripheral wall 18A at least one flushing opening 303 is provided, opening into the third compartment 300, below the foil 302. Moreover in this embodiment at least one second flushing opening 310 is provided in the wall 19 of the second compartment 15. In FIG. 3B air present in the third compartment 300 has been removed from the third compartment, for example through the flushing opening 303, pulling the foil 302 into the third compartment 300, preferably against the inside of the peripheral wall 18A and the bottom wall 18, as shown in FIG. 3B. Prior to and/or during deformation the foil 302 can be heated below a melting temperature, as schematically shown in FIG. 3B by heater 311. The foil 302 can be plastically deformed, such that after cooling it can lay against said walls 18, 18A substantially without tension in the foil 302. The foil 302 can be vacuum formed in situ in the pressure regulator 12. Alternatively it can be formed outside the regulator 12 and then be mounted, for example by welding.

Figure 3C:
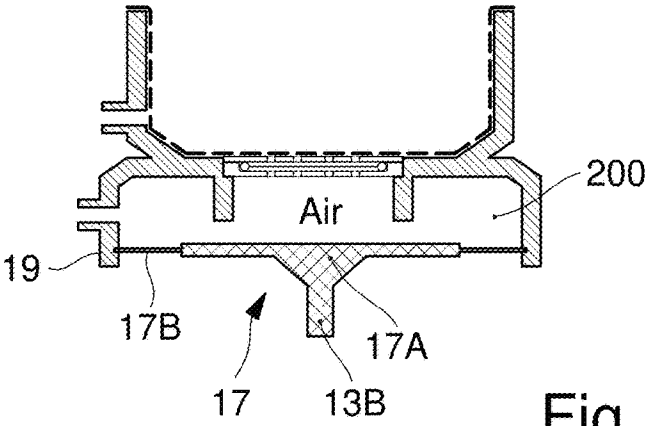

FIG. 3C shows a movable and/or deformable wall 17, such as a permeable wall part as discussed in FIG. 2, which has been connected to the wall 19 of the second compartment 15, for closing the lower side end thereof. The stem 13B extends from the center portion 17A.

FIG. 3D shows a ring 312 being mounted on the upper edge 18B of the peripheral wall 18B, over the foil 302. The ring 312 may comprise a provision for mounting it to the lid 304, as will be discussed. Here this is shown by way of an outward extending flange 313.

If these steps are taken in atmospheric conditions, the second and third compartments 15, 300 will be filled with air under atmospheric pressure.

Figure 3F:
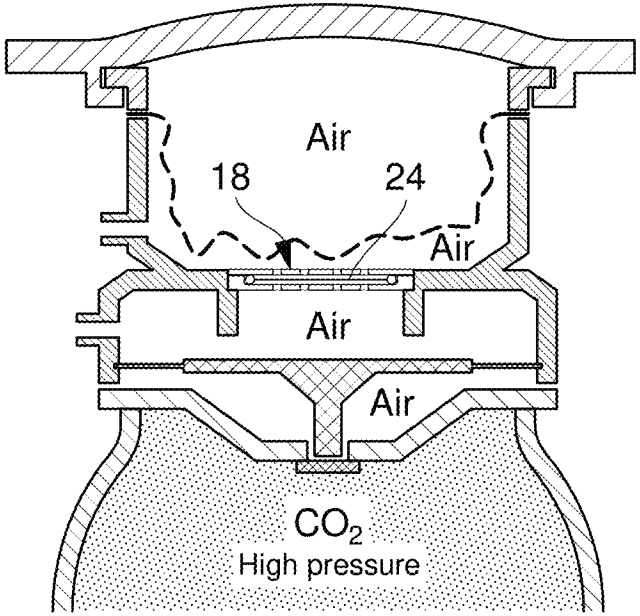
Figure 3E:
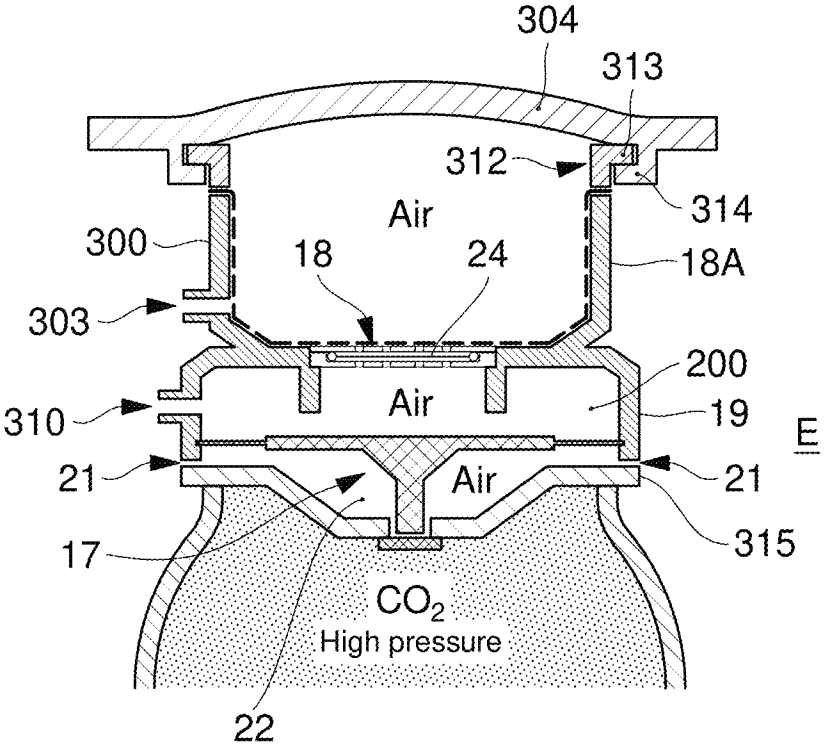

FIG. 3E shows the pressure regulator 12 connected to a lid 304 by hooking the flange 313 below hooking provisions 314 on an inside of the lid 304. Alternative means for mounting can obviously be provided, including but not limited to screwing, bolting, welding, gluing, integral forming with the ring, riveting or other means known in the art. Furthermore a pressure container 11 or first compartment 100 is mounted to the wall 19, forming an outlet space 22 between the upper side 315 of the pressure container 11 and the movable and/or deformable wall 17. One or more outlet openings 21 are provided for connecting the outlet space 22 with the environment E outside the pressure regulator 12.

As can be seen in FIG. 3F, gas, for example air can then be forced into the third chamber 300, through the at least one flushing opening 303, forcing the foil 302 away from the walls of the third chamber 300. In FIG. 3F the foil 302 is shown in a position substantially free from the walls 18, 18A. As can be seen the foil 302 can for example be rippled or crumpled and is preferably substantially free of tension. The foil 302 can hence be deformed easily without any significant pressure difference over the foil 302.

It will be clear that in embodiments in which there is no third compartment the regulating chamber 15 can be flushed with gas such as $CO_2$ in a similar manner.

In FIG. 4A-C three steps are shown for preparing a pressure regulator comprising a third compartment 300 for use in a beverage container.

In FIG. 4A the pressure regulator 12 is shown, mounted on a gas container 11 or first compartment 100 containing pressurized gas, for example $CO_2$. Such gas may be pressurized such that it is partly liquefied. Air is being drawn from the third chamber 300, through the opening 303, pulling the foil 302 back against the inside of the walls 18, 18A of the third compartment 300. At the same time air is being drawn from the second compartment 15 through the further flushing opening 310. Thus preferably as much air and hence as much oxygen as possible is removed from the pressure regulator, especially form the third compartment 300 and the second compartment 15.

In FIG. 4B then flushing of pressure regulator with gas is shown, preferably the same gas, which could also be understood as a gas mixture, as is provided in the first compartment 11, 100, to be used for pressurizing beverage in a container. In the embodiment shown the gas is $CO_2$ gas. The gas is introduced into the third chamber 300 through the flushing opening 303, forcing the foil 302 outward. Moreover the gas will be allowed into the second compartment 15, preferably by using the further flushing opening 310. In embodiments gas may be introduced through the further flushing opening, at the same time allowing any remaining air as much as possible to escape through the same or a different flushing opening. In embodiments for example the further flushing opening may be used for sucking, whilst gas is introduced through the flushing opening 303 into the third compartment 300, wherein the gas can flow into the second compartment through the permeable wall part 24 in the wall 18. Combinations of these embodiments can also be used. Preferably both compartments 15, 300 are filled with the relevant gas or gas mixture only. In FIG. 3-7 a lid 304 is mounted on the pressure regulator 12, above the third chamber 300, if provided for. This lid 304 can for example be made of plastic or metal and can be a lid 304 which can close off a filling opening of the container, as will be discussed. The lid 304 can moreover form a stop 305 for the pressure regulating wall, especially the foil 302 and thus defining a maximum volume $V_{300}$(max) of the third chamber 300, whereas a minimum volume $V_{300}$(min) is in the embodiments shown substantially zero.

After having introduced the gas into the third compartment 300, especially the maximum volume, as can be seen in FIG. 4C, the at least one flushing opening 303 can be closed, for example by a stopper or by welding, entrapping the gas inside the pressure regulator 12. In this position gas substantially cannot escape from the third chamber 300, other than into the second compartment 15. Similarly the or each further flushing opening 310 can be closed. Preferably as shown the volume $V_{15}$ of the second compartment 15 is significantly smaller than the maximum volume $V_{300}$(max) of the third compartment 300. For example a maximum volume of the second compartment 15 may be less than half the maximum volume of the third compartment 300. Since the regulator will be placed in a beverage container in an environment of the same gas, substantially no gas will migrate into or out of the compartments.

FIGS. 5A and B show a pressure regulator system of the disclosure mounted in a beverage container 1. The regulator system comprising the regulator 12 and first compartment 100, i.e. the gas container 11 is inserted through a filling opening 305 of the container 1, after the beverage compartment 3 of the container 1 has been filled with a beverage, especially a pressurized beverage, preferably a gas containing beverage such as a carbonated beverage, such as beer. The lid 304 from which the pressure regulator 12 is suspended is mounted to the rim 317 of the filling opening 305, for example by welding, such as but not limited to laser welding, or any other suitable manner, closing off the beverage compartment 3. A dip tube 316 has been mounted to an outlet 8, for example to a dispensing provision 6 such as a tap 7 which can be connected to the lid 304 directly or by for example a beverage line or the like, in any suitable manner.

As can be seen in FIG. 5A the container 1 will be filled with a beverage 4, such as beer, which may contained a collar of foam 4A. Above the foam 4A a head space 5 is shown, which may be filled with air or a mixture of air and gas such as CO2. When the pressure regulator 12 with the gas container 11 and dip tube 316 is introduced through the filling opening 305, the beverage level in the container will rise, pushing the collar of foam 4A up to the rim 305. Thus all air is evacuated.

Figure 5B:
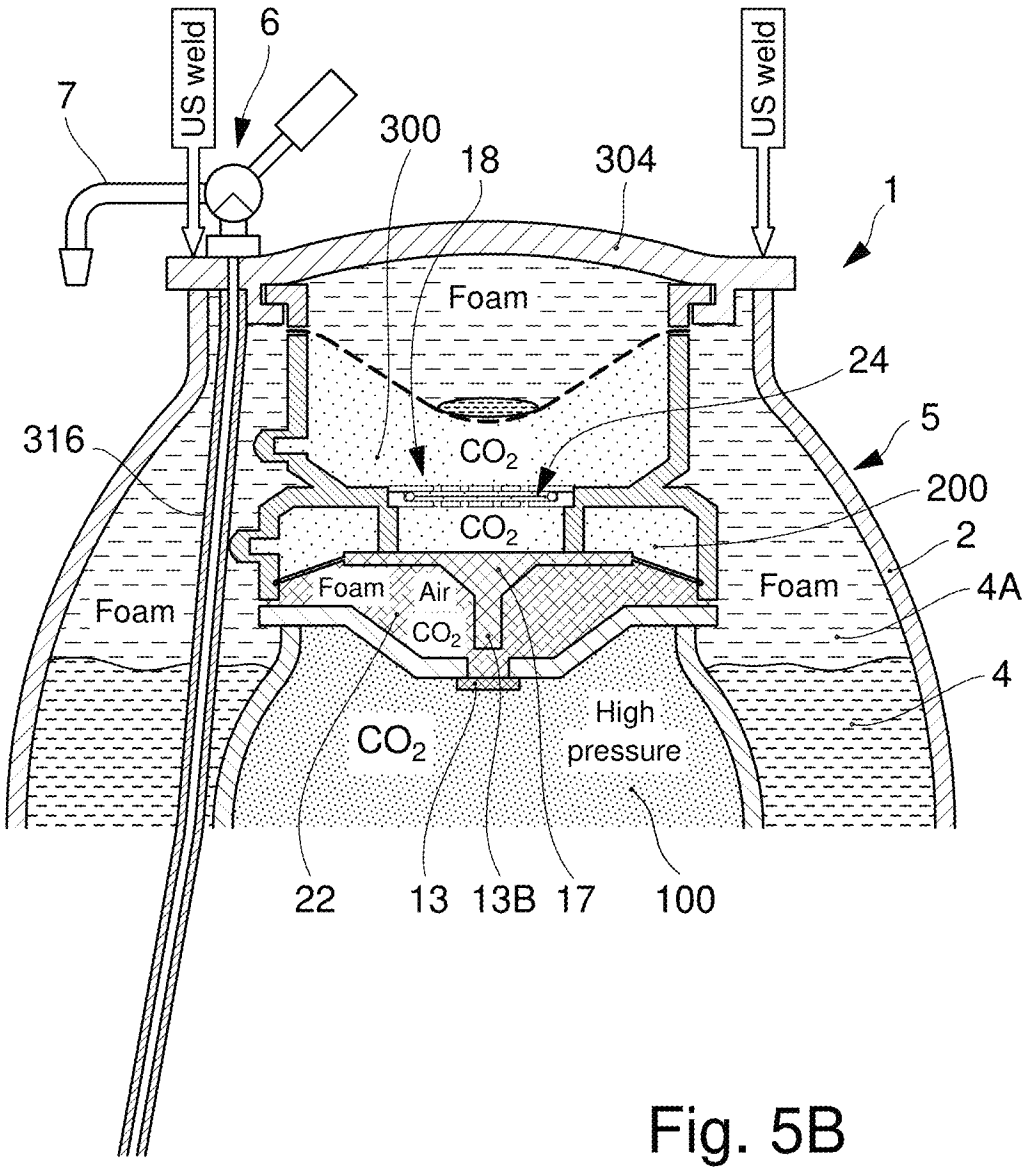

In FIG. 5B the container 1 is shown after filling and closing. The lid 304 has been mounted to the rim 305 in any suitable manner, such as for example but not limited to by welding, such as ultrasonic welding. The pressure in the outlet space 22 of the pressure regulator 12, which is in open connection with the beverage compartment 3 and will thus have substantially the same pressure, will allow the wall 17 to be forced down, opening the valve and allowing gas to flow from the first compartment 100 into the beverage compartment 3 through the outlet space 22 or directly into the beverage compartment 3. This will increase the pressure in the beverage compartment. In FIG. 5B the container 1 is shown after having been closed. Since the pressure in the outlet space 22 has also been raised, the wall 17 is forced upward, reducing the volume $V_{15}$ of the second compartment 15 and closing the valve 13 again.

It will be clear that at least gas can easily pass the connection between the ring 312 and the lid 304, such that the pressure inside the beverage compartment can act on the separating wall 301 or, if no third compartment is provided for, on the permeable wall part 24. After a while the foam 4A will largely settle and be liquefied again, leaving a head space 5 substantially filled with gas.

In this position the container 1 will be transported and stored. Due to the permeable wall part(s) 24 a pressure equilibrium will result between the second compartment 15 and its surroundings, especially the beverage compartment 3, which will be substantially the same as the equilibrium pressure of the beverage in the container at the given temperature. Such is for example shown in FIG. 6. As discussed, the presence of a third compartment as described will not significantly alter this.

Should during for example storing or transport of the container with the beverage the pressure inside the beverage compartment 3 change, for example resulting from a temperature change, the permeable wall part 24 will allow the pressure in the second compartment 15 to follow such change, adjusting the regulating pressure inside the second compartment 15 to match the changed equilibrium pressure in the beverage.

In FIGS. 7A and 7B by way of example two possible situations are shown. Pressure inside the beverage container will be relatively low, for example due to significant cooling of the container 1 and beverage therein. In FIG. 7B on the other hand a high pressure may prevail in the beverage container, for example due to warming. Since temperature and pressure changes during storage and transport will normally happen only gradually, the pressure in the pressure regulator will follow the pressure change in the beverage compartment by allowing gas to flow from the third compartment into the second compartment or vice versa, through the at least one permeable wall part 24, acting as throttle(s). For example, increase in the pressure in the beverage compartment will over time make gas to pass into the second compartment 15, increasing the regulating pressure in the second compartment 15 to about the pressure in the beverage compartment 3. On the other hand, decreasing pressure in the beverage compartment 3 will allow gas to pass from the second compartment 15, decreasing the regulating pressure to about the pressure in the beverage compartment 3. Hence the regulating pressure will follow relatively slow pressure changes in the beverage.

However, if beverage is dispensed from the container 1, as shown in FIGS. 8A and 9, the pressure $P_1$ will drop rapidly in the beverage compartment 3. This means that the pressure will also drop inside the outlet space 22, allowing the wall 17 to be forced down, opening the valve 13 and allowing gas to flow into the beverage compartment 3, raising the pressure again. This will all happen in seconds, during which time no or only a very limited amount of gas will pass from the beverage compartment 3 or, if provided for, the third compartment 300, into the second compartment 15. This means that the pressure in the second compartment 15 will not significantly change due to such gas entering the pressure regulating chamber 15. This means that after a short while the pressure $P_1$ inside the beverage compartment 3 will again be back at the regulating pressure and the valve 13 will be closed again since the wall 17 will have been forced back up. Hence the regulating pressure will be maintained at the desired level, despite the dispensing of beverage.

As can be seen in FIG. 9, after several servings have been dispensed through the tap 7, the pressure may still be accurately regulated. If the equilibrium pressure would change in the container 1, due to for example the remaining gas volume or due to the significantly reduced beverage volume, the regulating pressure in the second compartment 15 may adjust slowly to the new equilibrium pressure.

FIG. 11-13 show embodiments, by way of example, wall structures of the permeable wall part of the pressure regulating chamber 15. In these embodiments the wall part 18, which is for example opposite the movable and/or deformable wall part 17, has a support structure 25 supporting the actual permeable wall part 24 which is formed mainly as a thin film or grid, laminate or the like as discussed here above. The support structure 25 supports the permeable wall part 24 at two opposite sides 24A, 24B, such that it will not significantly deform, for example not significantly bulge inward, i.e. into the pressure regulating chamber 15, nor bulge outward, i.e. into the beverage compartment or third chamber. The rigidity of the wall 18 is thus preferably such that the volume of the pressure regulating chamber 15 does during use only change because of movement and/or deformation of the deformable and/or movable wall part 17.

In the embodiment of FIGS. 11A and B the permeable wall part 24 is formed by a substantially flat piece of material of multi layer of materials, enclosed between two more rigid layers 125A and 125 B (e.g. providing a support structure 25), preferably plastic layers comprising relatively large openings 27 allowing gas to reach the permeable wall part 24 easily, preferably without a relevant pressure change due to said openings 125C, D.

In the embodiment of FIG. 11 at least one of the layers 125A, B is provided with a circumferentially closed, upstanding ridge 125E, The permeable wall part 24 is pressed against the ridge 125E, forming a seal 127 sealing the permeable wall part 24 against at least one of said layers 125A, B and thus preventing gas to pass around said permeable wall part 24 from the pressure regulating chamber 15 to the beverage compartment 3 or, if provided for, the third compartment 300 or vice versa. Hence any gas passing between the pressure regulator chamber 15 and the beverage compartment 3 or the third compartment 300 or vice versa will have to be through the permeable wall part 24.

In FIGS. 12 and 13 an alternative embodiment for a wall or wall part 18 is disclosed, comprising again an inner and outer layer 125A, B provided with openings 27, for example as discussed here above. The permeable wall part 24 can be sandwiched between said layers 125A, B. In this embodiment the permeable wall part 24 is molded such that it has at least one rim portion 126 which is compressed between the two layers 125A, B such as to form a seal 127 preventing gas passing alongside the permeable wall part 24, as discussed here before, only allowing gas to pass through the permeable wall part 24.

In FIG. 14 an alternative permeable wall part is shown, schematically in cross section, in which a relatively stiff carrier 128, for example of a plastic or metal mesh material or an element provided with an array of openings 129, which is impregnated or covered by or in which in said openings a gas permeable, liquid tight material is provided, such as for example silicone or an other material as discussed here below, allowing gas to pass through the permeable wall part without significant deformation of the permeable wall part 24 due to pressure differences occurring over said wall part during use. In FIG. 14 an element 128 is shown, schematically, with openings 129 which are relatively large, and which are covered by a relatively thin layer 130 of silicone. The layer 130 preferably has a thickness smaller than a maximum diameter or width or such cross sectional measure of the openings 129, and is preferably adhered to the element 128 between the openings 129, supporting the layer 130. In FIG. 14 the layer 130 is shown as transparent in order to show the openings 129, but it may well be non-transparent or translucent.

Obviously combinations of a wall part 24 according to FIG. 14 and a support structure 25, for example as shown in FIG. 11 or 12 can also be used.

In embodiments the wall 18 and especially at least one or both of the layers 125 can be made integrally with the further wall of the pressure regulating chamber, wherein e.g. at least one of the layers 125 can be formed as a hinging, folding or sliding part which can be closed over the wall part 24 after having been placed on the other of the layers. Alternatively the wall 18 can be made separately and then mounted to close the chamber 15, for example mounted by welding, press fit, screw threads, clamping or any other suitable manner.

In an aspect of the present invention the permeable wall part can have a permeability defined by formula (1) as discussed here below, using a parameter referred to as Zeta (ζ). Zeta is defined as the time constant of the exponential decay of pressure in the pressure regulating chamber 15 if the chamber starts at a higher pressure than the surrounding gas:

$$P(t) - P_{amb} = (P(0) - P_{amb}) * e^{-zeta*t} \quad (1)$$

Zeta=the fraction of the chamber volume that is, under given conditions, filled in 1 second, multiplied by (delta(P)/$P_{abs}$);

P(t)=the pressure in the pressure regulating chamber at a given time;

$P_{amb}$=ambient pressure;

P(0)=the pressure in the regulating chamber at the start (i.e. just before the draughting action has started;

In particular, Zeta can be expressed by the following formula 2:

$$\zeta = \frac{R\,T\beta \cdot A_{perm}}{V_{ch}\,dperm} \quad (2)$$

or by the formula 3

$$\zeta = \frac{P \cdot \varphi}{\Delta P \cdot V_{ch}}, \quad (3)$$

wherein:

R=the gas constant;

T=temperature in the pressure regulating chamber (K);

β=permeability of the [mol/m·s·Pa];

$A_{perm}$=Surface area for permeation of the wall part 24;

$V_{ch}$=Chamber volume of the pressure regulating chamber;

$D_{perm}$=thickness of the permeable wall part 24;

P=pressure at low pressure side of the pressure regulating chamber (Pa);

ΔP=pressure difference over the permeable wall part 24 (Pa);

φ=Leakrate under given test conditions [$m^3$/s].

Regarding leakrate φ and respective test conditions it will be appreciated that leakrate of the permeable wall can simply be determined by applying a predetermined pressure difference over the wall and measuring a resulting flowrate, or alternatively calculating the flow rate based on the pressure drop.

In a further embodiment it has been found that good results can be obtained in case Zeta is about 0.00250 [1/s]. In particular, according to a preferred embodiment, Zeta can be in the range of 0.00125 to 0.005 [1/s].

For example, in a non-limiting example a required Zeta can be converted into permeability for the used material, using the following exemplary parameters:

an effective permeation surface of the wall part 24 of 400 $mm^2$;

a chamber volume of the pressure regulating chamber of 3.3 $mm^3$; and a thickness of the material of the wall part 24 of 0.08 mm;

which leads to permeability properties of the material of the wall part 24 of about 2050 barrer (nominal). A preferred range can be e.g. 1000 to 4000 barrer (or 1050 to 4000 barrer).

During use for a system according to the present disclosure the rate of passage of gas through the permeable wall part 24 will depend on a pressure difference over said permeable wall part 24. During use a pressure difference over the permeable wall part 24 may exists temporarily, for example because of dispensing beverage and/or change in temperature of the beverage, which pressure difference will normally be well below 1 bar. For the design of the system also the pressure regulating chamber volume $V_{200}$ is of importance; for a larger pressure regulating chamber 15 more gas passage is allowed for the same performance of the system. For this reason the variable 'Zeta' is introduced It should be noted that the factor ζ is not a constant, because the delta(P) reduces over time. See for example the graph in FIG. 16, showing the change of the pressure prevailing in the pressure regulating chamber over time, based on a given factor ζ.

In an advantage embodiment the permeable wall part is made using silicone material because of its relatively high permeability for $CO_2$, and fluid tightness. An additional advantage of using silicon may be that the flexibility of the material allows for easy forming of a seal as discussed.

The permeable wall part 24 can have various configurations and include various materials, as e.g. follows from the above, for example, an exemplary embodiment of the permeable wall part 24 can include one or more of:

a foil, especially a plastic foil or silicone foil, preferably a substantially non-elastic foil;

a laminate;

an injection moulded part;

impregnated woven part; and an impregnated non-woven part.

Also, it will be clear that various suitable materials can be used for forming the permeable wall part 24 (e.g. other than the above-mentioned materials), such as for example material chosen from the non limiting group comprising: Polymers for modified atmospheric packaging, especially polyolefins, filled LDPE, metallocene polyethylene (mPE), bi-axially stretched beta-nucleated polypropylene, side chain crystalline polymer, and polymers for gas separation, especially ladder PIM polymers, PIM-Pls (Polyimides), mixed matrix membrane (MMM) with metal organic frameworks (MOF's), (fluorinated) F-polymers, Teflon (PTFE) AF-2400, block copolymers, microperforated polymer (BreatheWay™), With a system of the present disclosure beverage can be dispensed, especially but not limited to beverage comprising a gas or gas mixture, such as beverage containing $CO_2$ and/or $N_2$ or mixtures of $CO_2$ and/or $N_2$ and other gas(ses).

In embodiments, for example as described here above, a pressure regulating system for a beverage container system is provided, comprising a first compartment for containing a pressurized gas, in fluid communication with a surrounding space through at least a gas valve for opening and closing a passage between the first compartment and surrounding space, wherein a gas valve control system is provided, comprising a deformable and/or movable wall or wall part, wherein said deformable and/or movable wall part is operably in contact with said gas valve for opening and/or closing said gas valve, wherein a second compartment is provided at a side of the said deformable and/or movable wall part, said movable and/or deformable wall part forming a wall of said second compartment, wherein the second compartment forms a pressure regulating space and comprises a wall part formed by or comprising at least a gas permeable, liquid tight permeable wall part, wherein a third compartment is provided over the gas permeable, liquid tight permeable wall part, at a side thereof opposite the second compartment. The third compartment preferably has a wall part, flexible and/or deformable and/or gas permeable, but liquid tight such that the volume of the third compartment can change without significant change in pressure inside said third compartment.

As described preferably at least the second compartment, more preferably the second and third compartment, if present, can be flushed or purged with a gas, such as for example but not limited to a gas similar to a gas provided in a beverage of which the pressure is to be regulated, prior to use of the pressure regulator. Thus for example any oxygen present in either one of these compartments can be replaced by said gas, preventing for example oxidation of the beverage during use of the pressure regulator and/or preventing regulating pressure changes due to exchange of different gasses through for example the gas permeable wall part.

By way of example, in an embodiment for dispensing beer, such as lager beer, containing $CO_2$ gas the pressure in a head space of the container will be the same as the pressure in the beverage. For beer for example an equilibrium pressure of about 1.6 bar (1,600,000 Pascal) absolute may be present at a beverage temperature of about 0° C., whereas the pressure may be about 5.5 bar ($5.5*10^6$ Pascal) at a temperature of about 40° C.

In an example the volume of the beverage compartment can be upwards from a liter, and the volume $V15_{(max)}$ can be about 4200 $mm^3$. The system can respond to quick pressure drops due to dispensing of beverage, for example a pressure drop of tenths of bars in less than a minute, by adding gas under pressure into the beverage compartment from the first compartment 100, whereas when for example a pressure change in the beverage compartment 3 occurs due to a change in temperature, which will take far longer, for example hours, gas may pass from the second compartment 15 to its surroundings or vice versa very slowly, such that the regulating pressure $P_2$ in the second compartment 15, which forms the pressure regulating chamber, will be amended to the equilibrium pressure in the head space 5.

FIG. 10A-E show alternative embodiments of pressure regulating walls or wall parts 301.

Figure 10A:
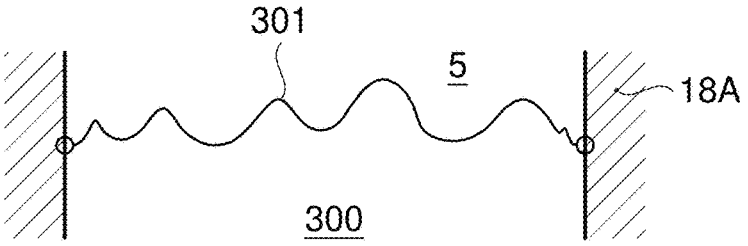
Figure 10B:
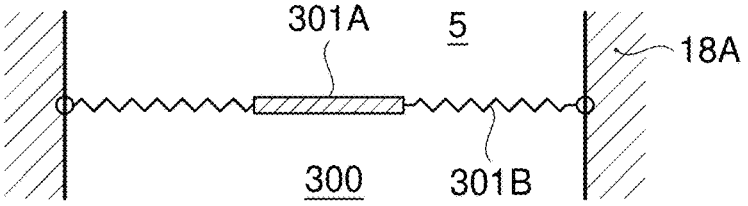
Figure 10C:
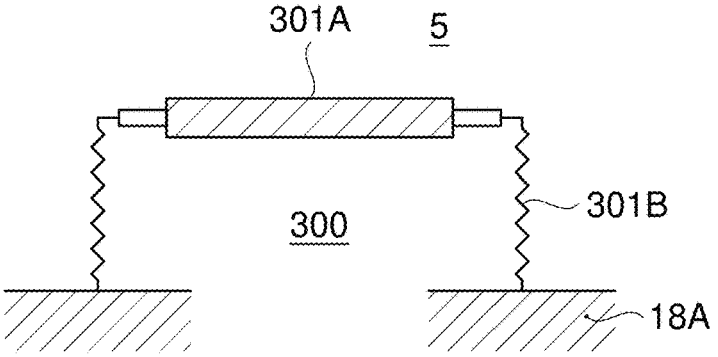
Figure 10D:
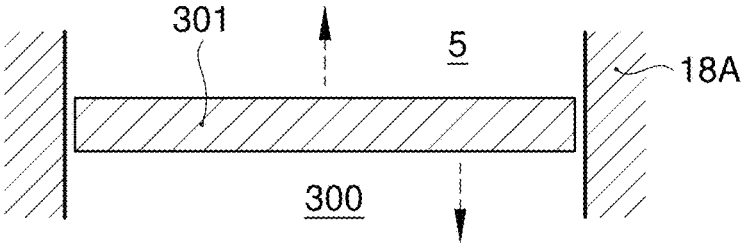
Figure 10E:
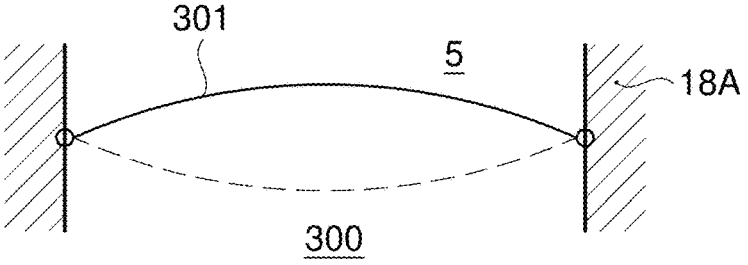

FIG. 10A shows the wall 301 formed as an undulating membrane fixed in a fixed position at the periphery to the peripheral wall 18A. FIG. 10B shows a combination of a relatively stiff plate element 301A connected to a flexible membrane ring 301B which in turn is connected sealingly to the peripheral wall 18A. FIG. 10C shows an embodiment similar to that of FIG. 10B, but here the flexible membrane portion is formed as a substantially tubular element 301B. FIG. 10D shows a piston type separating wall 301, which seals against an inner side of the peripheral wall 18A at very low friction, for example by suing a friction reducing plastic or coating, such as but not limited to Teflon. FIG. 10E shows an embodiment of a separating wall 301 which is substantially continuous and which is highly flexible and stretchable, such that it can change shape between the V300(min) and V300(max) without significant force necessary. Such can for example be made of a rubber or artificial rubber, silicon or the like and very thin, for example one to several micrometers or less.

The present invention is by no means limited to the embodiments shown and discussed by way of example only. Many variations thereof are possible within the scope of the appending claims. For example a pressure regulator can be enclosed entirely inside the beverage compartment or can be formed as an integral part of the container. Other materials can be used in forming a gas permeable wall part 24, whereas the permeable wall part 24 can be positioned differently, for example in a side wall of the pressure regulating wall or in or next to the movable and/or deformable wall part 17. Other types of valves and dispensing systems can be used. Combinations of embodiments as discussed here above are also considered as disclosed. These and may comparable variations, as well as combinations thereof, are understood to fall within the framework of the invention as outlined by the claims. Naturally, different aspects of the different embodiments and/or combinations thereof can be combined with each other and be exchanged within the framework of the invention. Therefore, the embodiments mentioned should not be understood to be limitative.

For example, the first compartment can be substantially filled with gas in various ways, including has in liquid form, gas in gaseous form, a mixture of gas in liquid form and gas in gaseous form, gas attached to e.g. carbon, and/or differently.

The invention claimed is:

1. A method for preparing a pressure regulating system for a beverage container system, comprising a pressure regulator, a first compartment for containing a pressurized gas, in fluid communication with a surrounding space through at least a gas valve for opening and closing a passage between the first compartment and surrounding space, wherein a gas valve control system is provided, comprising a deformable and/or movable wall or wall part, wherein said deformable and/or movable wall part is operably in contact with said gas valve for opening and/or closing said gas valve, wherein a second compartment is provided at a side of said deformable and/or movable wall part, said movable and/or deformable wall part forming a wall of said second compartment, wherein the second compartment forms a pressure regulating space and comprises a wall part formed by or comprising at least a gas permeable, liquid tight permeable wall part, wherein at least the second compartment is purged with a gas or gas mixture which is present in a beverage to be pressurized with said pressure regulator.

2. The method according to claim 1, wherein the gas permeable, liquid tight permeable wall part is configured such that during use the gas can enter into the second compartment and/or leave therefrom.

3. The method according to claim 1, wherein the gas permeable wall part is provided with a support frame, wherein the support frame has a stiffness higher than the permeable wall part.

4. The method according to claim 1, wherein first compartment is in open communication with the surrounding space when the gas valve is open.

5. The method according to claim 1, wherein during use at least the first and second compartment are substantially filled with the same gas or gas mixture, in gaseous and/or liquid form.

6. The method according to claim 1, wherein at least the second compartment comprises at least one flushing opening, which during use of the regulator for pressure regulation is closed.

7. The method according to claim 1, wherein at least the second compartment is flushed with said gas or gas mixture, by feeding the gas or gas mixture into the second compartment through a first opening and allowing air to be forced out of said second compartment by said gas or gas mixture through a second opening, and subsequently closing the openings.

8. The method according to claim 1, wherein the permeable wall part connects the pressure regulating chamber with a third compartment extending over said permeable wall part, preventing direct communication between the pressure regulating chamber and the beverage compartment, wherein the third compartment is also purged with said gas or gas mixture.

9. The method according to claim 1 wherein the gas or gas mixture present in a beverage to be pressurized with said pressure regulator comprises $CO_2$ gas or $N_2$ gas or a $CO_2/N_2$ gas mixture.

10. The method according to claim 4, wherein the surrounding space comprise a beverage compartment.

11. A method for use of a pressure regulating system within a beverage dispensing container, wherein the pressure regulating system comprises at least a pressurized gas filled compartment and a pressure regulating chamber, wherein prior to use the pressure regulating chamber is purged with a gas and is thereafter closed, filled with said gas, wherein the method comprises removing a fluid from the beverage dispensing container, and in response thereto, the pressure regulating chamber is operative to open a valve to allow the gas from the pressurized gas filled container to flow into the beverage dispensing container.

12. The method according to claim 11, wherein the pressure regulating chamber is purged using at least one opening, which the at least one opening is closed after said purging.

* * * * *